United States Patent [19]

Aono et al.

[11] Patent Number: 5,064,742

[45] **Date of Patent: * Nov. 12, 1991**

[54] DRY IMAGE-FORMING PROCESS USING THERMAL SOLVENTS

[75] Inventors: Toshiaki Aono; Koichi Nakamura, both of Kanagawa, Japan

[73] Assignee: Fuji Photo Film Co., Ltd., Kanagawa, Japan

[ * ] Notice: The portion of the term of this patent subsequent to Sep. 25, 2001 has been disclaimed.

[21] Appl. No.: 504,068

[22] Filed: Mar. 29, 1990

Related U.S. Application Data

[63] Continuation of Ser. No. 592,203, Mar. 22, 1984, abandoned.

[30] Foreign Application Priority Data

Mar. 25, 1983 [JP] Japan ..... 58-48753

[51] Int. Cl.[5] ..... G03C 5/54

[52] U.S. Cl. ..... 430/203; 430/226

[58] Field of Search ..... 430/203, 226

[56] References Cited

U.S. PATENT DOCUMENTS

| | | | |
|---|---|---|---|
| 3,227,550 | 1/1966 | Whitemore et al. | 430/226 |
| 4,124,387 | 11/1978 | Kohrt | 430/203 |
| 4,430,415 | 2/1984 | Aono et al. | 430/203 |
| 4,455,363 | 6/1984 | Naito et al. | 430/226 |
| 4,473,631 | 9/1984 | Hirai | 430/203 |
| 4,483,914 | 11/1984 | Naito et al. | 430/203 |
| 4,500,624 | 2/1985 | Aono et al. | 430/203 |
| 4,504,568 | 3/1985 | Clark et al. | 430/203 |

FOREIGN PATENT DOCUMENTS

| | | | |
|---|---|---|---|
| 0067455 | 12/1982 | European Pat. Off. | 430/203 |
| 2100016 | 12/1982 | United Kingdom | 430/218 |

*Primary Examiner*—Richard L. Schilling

*Attorney, Agent, or Firm*—Sughrue, Mion, Zinn, Macpeak & Seas

[57] ABSTRACT

A dry image-forming process is disclosed which comprises transferring a mobile hydrophilic dye formed imagewise at exposure areas of a heat developable light-sensitive material comprising a support having thereon at least a light-sensitive silver halide, a hydrophilic binder, a reducing agent for the silver halide, and a non-diffusible 2-equivalent coupler by heating the light-sensitive material after imagewise exposure or simultaneously with imagewise exposure in the presence of a hydrophilic thermal solvent at a high temperature at which the hydrophilic thermal solvent is in a molten state without supplying a solvent from the outside, and fixing the dye in a dye-fixing layer.

18 Claims, No Drawings

DRY IMAGE-FORMING PROCESS USING THERMAL SOLVENTS

This is a continuation of application Ser. No. 06/592,203, filed Mar. 22, 1984, now abandoned.

FIELD OF THE INVENTION

This invention relates to a process of forming images by a completely dry development. More particularly, the invention relates to a completely dry image-forming process wherein hydrophilic dyes formed in a heat developable light-sensitive material containing 2-equivalent couplers are fixed in a dye-fixing layer, without supplying a solvent from the outside.

BACKGROUND OF THE INVENTION

Since a photographic process using silver halide is excellent in photographic characteristics such as sensitivity, gradation control, etc., as compared to other photographic processes such as electrophotographic process and diazo photographic process, the silver halide photographic process has hitherto been most widely used. Recently, a technique capable of more easily and rapidly obtaining images has been developed by changing an image-forming process by a light-sensitive material using silver halide from a conventional wet process such as a process by a liquid developer to a dry process such as a developing process by heating Heat developable light-sensitive materials are known in the field of the art and the heat developable light-sensitive materials and image-forming processes using these light-sensitive materials are described in, for example, U.S. Pat. Nos. 3,152,904, 3,301,678, 3,392,020, 3,457,075, British Patents 1,131,108, 1,167,777, and *Research Disclosure*, (RD-17029), June 1978, pages 9–15.

Also, for obtaining color images, various processes are proposed as illustrated below.

For example, dyes and bleaching processes useful for a process of forming positive color images by a silver dye bleaching process utilizing heat is described in, for example, Research Disclosure (RD-14433), April 1976, pages 30–32, *ibid.*, (RD-15227), December 1976, pages 14–15, U.S. Pat. No. 4,235,957, etc. However, the foregoing process has the faults that an additional step of superposing an activating agent-containing sheet for accelerating a bleach of dye onto the heat developing light-sensitive material followed by heating is required and also the color images obtained are gradually bleached due to the reduction function of free silver existing together with the color images during the preservation of the light-sensitive material for a long period of time.

Also, a process of forming color images utilizing leuco dyes is described in, for example, U.S. Pat. Nos. 3,985,565 and 4,022,517. However, this process has such faults that the stable incorporation of leuco dyes in a photographic material is difficult and also the photographic material is gradually colored during the preservation thereof.

Furthermore, a process of introducing a nitrogen-containing heterocyclic ring to a dye, forming a silver salt, and liberating the dye by heat development is described in *Research Disclosure* (RD-16966), May 1978, pages 54–58. However, in the process it is difficult to control the liberation of the dye at unexposure areas and hence the process is unsuitable for a general process.

Moreover, for a process of forming color images by a combination of the oxidation product of a developing agent and couplers, a combination of a p-phenylenediamine series reducing agent and a phenolic or active methylene coupler is described in U.S. Pat. No. 3,531,286; p-aminophenol series reducing agents are described in U.S. Pat. No. 3,761,270; sulfonamidophenol series reducing agents are described in Belgian Patent 802,519 and *Research Disclosure* (RD-13742), September 1975, pages 31 and 32, and a combination of a sulfonamidophenol series reducing agent and a 4-equivalent coupler is described in U.S. Pat. No. 4,021,240. However, these processes have such a fault that color images formed become turbid since the images of reduced silver and color images are simultaneously formed at the exposure areas after heat development.

Furthermore, in these conventional processes there is a fault that the reducing agent is oxidized by the unreacted silver halide at unexposure areas and the oxidation product is reacted with couplers to increase fogs.

The inventors previously proposed a novel light-sensitive material which can overcome the difficulties in these conventional processes (see, Japanese Patent Application (OPI) No. 149046/83 (the term "OPI" as used herein refers to a "published unexamined Japanese patent application")). The light-sensitive material is a diffusion transfer type heat developable light-sensitive material comprising a support having thereon at least a light-sensitive silver halide, a hydrophilic binder, a reducing agent to the silver halide, and a non-diffusible 2-equivalent coupler and color images having high quality can be obtained by heating the light-sensitive material after imagewise exposure or simultaneously with imagewise exposure, and transferring the mobile dye thus formed imagewise into a dye fixing layer with supplying a solvent mainly from outside.

SUMMARY OF THE INVENTION

As a result of further performing investigations on the foregoing heat developable light-sensitive materials, the inventors have discovered that when the mobile dye formed by heating the foregoing light-sensitive material in the state of substantially containing no water after imagewise exposure or simultaneously with imagewise exposure is a hydrophilic dye, the dye can be transferred by only heating in the presence of a hydrophilic thermal solvent without particularly supplying a solvent from the outside, and based on the discovery, the invention has been attained.

An object of this invention is, therefore, to provide an easy process of transferring a mobile hydrophilic dye image formed in a heat developable light-sensitive material containing a 2-equivalent coupler into a dye-fixing layer and reducing the occurrence of turbidity of color images due to silver images formed simultaneously with the formation of the mobile dye.

Other object of this invention is to provide an easy process of transferring a mobile hydrophilic dye image formed in a heat developable light-sensitive material containing a 2-equivalent coupler into a dye-fixing layer and eliminating the formation of fog and stain in the color images during the preservation of the light-sensitive material after heat development.

A further object of this invention is to provide a process of forming high quality color images in a dye-fixing layer by only heating a heat developable light-sensitive material containing a 2-equivalent coupler without supplying a solvent from the outside in the whole steps from exposure to dye fixing.

That is, according to this invention, there is provided a dry image-forming process which comprises transferring a mobile hydrophilic dye formed imagewise at exposure areas of a heat developable light-sensitive material comprising a support having thereon at least a light-sensitive silver halide, a hydrophilic binder, a reducing agent for the silver halide, and a non-diffusible 2-equivalent coupler by heating the light-sensitive material after imagewise exposure or simultaneously with imagewise exposure in the presence of at least one kind of hydrophilic thermal solvent at high temperature at which the hydrophilic thermal solvent is in a molten state without supplying a solvent from the outside, and fixing the dye in a dye-fixing layer.

DETAILED DESCRIPTION OF THE INVENTION

The heat developable light-sensitive material used in this invention can simultaneously provide a silver image which is in a negative-positive relation to an original and a mobile hydrophilic dye at the areas corresponding to the silver image by performing only heat development after or simultaneously with imagewise exposure.

That is, when the heat developable color light-sensitive material is imagewise exposed and developed upon heating, an oxidation reduction reaction occurs between the light-sensitive silver halide and the reducing agent with the exposed silver halide as a catalyst to form a silver image at the exposed areas. In this step the reducing agent is converted into an oxidized material, which causes a coupling reaction with the non-diffusible 2-equivalent coupler to form, thereby, an image composed of a mobile hydrophilic dye. In this case, if an organic silver salt oxidizing agent exists in the light-sensitive material, an image having a high density can be easily obtained and hence the use of such an oxidizing agent is preferred.

The term "non-diffusible property" in this invention means a state that the movement of the molecule in hydrophilic binder is restrained mainly by the size and the form of the molecule. A coupler can be rendered non-diffusible by incorporating a non-diffusible ballast group into a releasable group of the coupler. On the other hand, a dye formed by the reaction of the coupler and the oxidation product of the reducing agent does not have the ballast group and hence it can easily move. Also, a 2-equivalent coupler is a coupler which requires the reduction of 2 mols of silver ions for forming 1 mol of a dye by causing coupling with the oxidation product of a reducing agent.

The non-diffusible coupler used in this invention is a substrate which forms a dye by combining with the oxidation product of a reducing agent formed by the reaction of a p-amionophenol derivative or a p-phenylenediamine derivative and a silver halide and the couplers are shown by the following general formulae (I) to (IX):

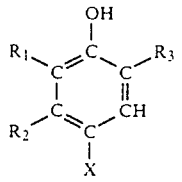

(I)

-continued

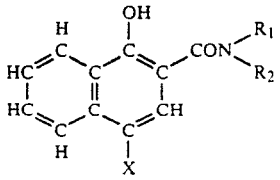

(II)

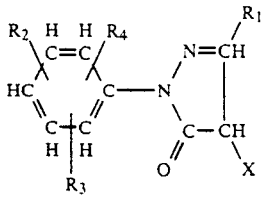

(III)

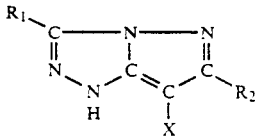

(IV)

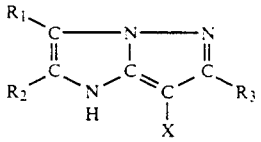

(V)

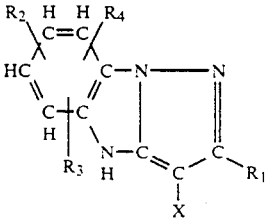

(VI)

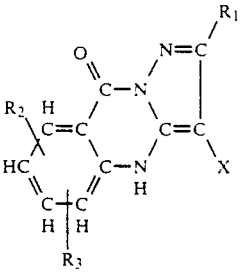

(VII)

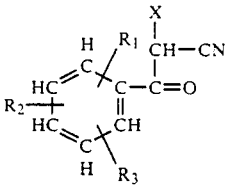

(VIII)

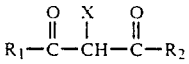

(IX)

wherein $R_1$ to $R_4$ each represents a hydrogen atom, an alyl group, an alkenyl group, a cycloalkyl group, an aryl group, an aralkyl group, an alkoxy group, an aryloxy group, an acyl group, an acyloxy group, an acylamino group, an alkoxyalkyl group, an aryloxyalkyl group, an alkoxycarbonyloxy group, an alkoxycarbonylamino group, an alkoxycarbonyl group, a carbamoyl group, a substituted carbamoyl group, a sulfamoyl group, a substituted sulfamoyl group, an amino group, an alkylamino group, a dialkylamino group, an arylamino group, a cycloalkylamino group, a halogen atom, a cyano group, an acyloxyalkyl group, a nitro group, an alkylsulfonyl group, an arylsulfonyl group, a hydroxy group, a carboxy group, a sulfo group, a ureido group, a substituted ureido group, a sulfamoylamino group, a substituted sulfamoylamino group, an alkylsulfonyloxy group, an arylsulfonyloxy group, an alkylsulfonylamino group, an arylsulfonylamino group, an alkylthio group, an arylthio group, a heterocyclic residue, an imido group, or a quaternary ammonium group. Also, each of these groups may further have a substituent such as a hydroxy group, a carboxy group, a sulfo group, an alkoxy group, a cyano group, a nitro group, an alkyl group, an aryl group, an aryloxy group, an acyloxy group, an acyl group, a sulfamoyl group, a substituted sulfamoyl group, a carbamoyl group, a substituted carbamoyl group, an acylamino group, an alkylsulfonylamino group, an arylsulfonylamino group, a sulfamoylamino group, a substituted sulfamoylamino group, an imido group, a halogen atom, and a quaternary ammonium group. The total carbon atom number of $R_1$ to $R_4$ is less than 12 and the carbon atom number of each substituent is 8 or less.

X is a group which is released at the case of combining with the oxidation product of a reducing agent, such as an alkoxy group, an aryloxy group, an acyloxy group, an alkoxycarbonyloxy group, a carbamoyloxy group, a substituted carbamoyloxy group, an alkylsulfonyloxy group, an arylsulfonyloxy group, an alkylsulfonylamino group, an arylsulfonylamino group, a perfluoroacylamino group, a sulfamoylamino group, a substituted sulfamoylamino group, an alkylsulfonyl group, an arylsulfonyl group, an alkylthio group, an arylthio group, a heterocyclicthio group, an arylazo group, a heterocyclic residue, and an imido group. Each of these groups may further have a substituent such as an alkyl group, an alkenyl group, a cycloalkyl group, an aralkyl group, an aryl group, a halogen atom, an alkoxy group, an aryloxy group, an acyl group, an acylamino group, an acyloxy group, an alkylsulfonylamino group, an arylsulfonylamino group, an alkylsulfonyloxy group, an arylsulfonyloxy group, an alkoxycarbonyl group, a substituted ureido group, an alkoxycarbonyloxy group, or an alkoxycarbonylamino group. The total carbon atom number of X is 8 or more.

The coupler used in this invention itself is not mobile but it forms a mobile dye by combining with the oxidation product of a reducing material. For the purpose, it is preferred that the substituents $R_1$ to $R_4$ in foregoing general formulae (I) to (IX) do not hinder the diffusion of the dye in a hydrophilic binder and, practically, it is desirable that $R_1$ to $R_4$ be relatively hydrophilic and has a low molecular weight. On the other hand, it is desirable that the substituent X be a high molecular weight moiety having high hydrophilic property acting as a ballast group, which restrains the diffusion of the coupler itself. Furthermore, the couplers used in this invention are required to meet the following conditions in addition to the conditions described above.

(1) The coupler forms an image-forming dye by efficiently combining with the oxidation product of a reducing agent.

(2) The dye formed in foregoing factor (1) has preferred hue for color reproduction.

(3) The dye formed in foregoing factor (1) has a large molecular extinction coefficient.

(4) The dye formed in foregoing factor (1) has a sufficient dyeing property for an image-receiving layer.

(5) The coupler is stable to light, heat, a reducing agent, an oxidizing agent, and other additives in the system.

(6) The coupler can be easily synthesized and can be easily soluble in an organic solvent.

Then, practical examples of the preferred couplers are shown below.

Yellow Coupler (Y-1)

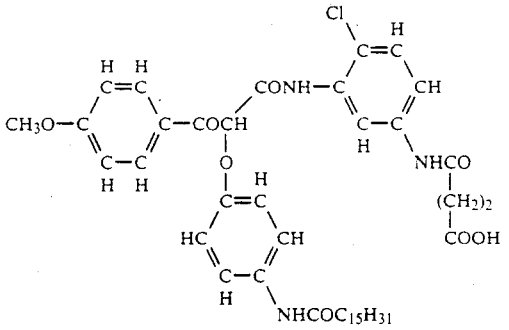

(Y-2)

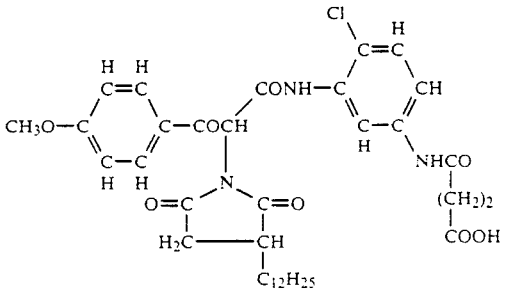

(Y-3)

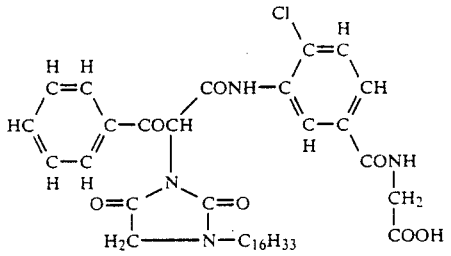

(Y-4)

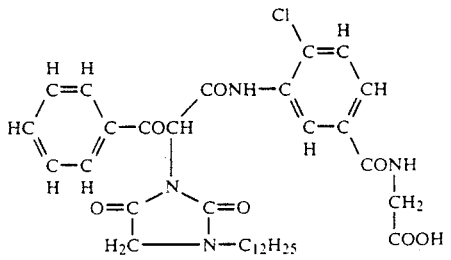

-continued
(Y-5)
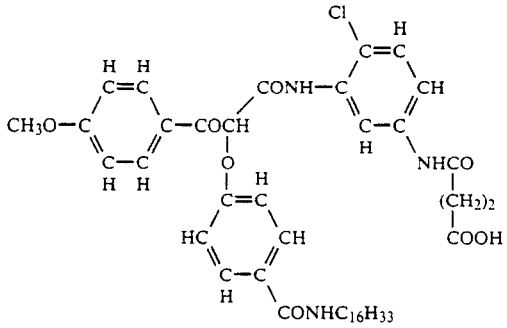
(Y-6)
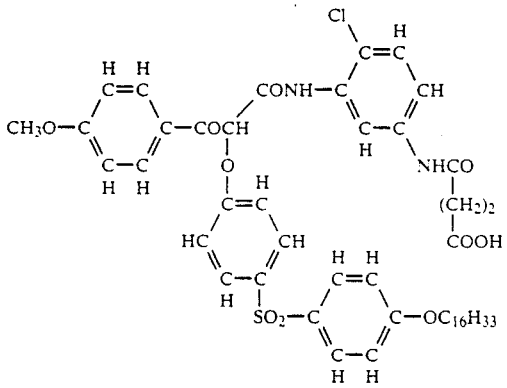
(Y-7)
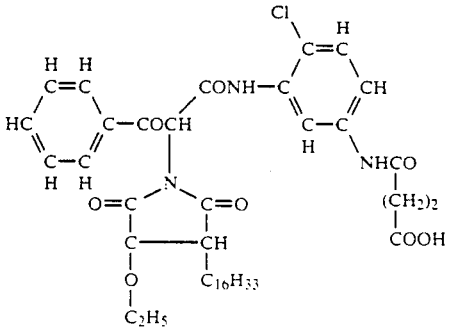
(Y-8)
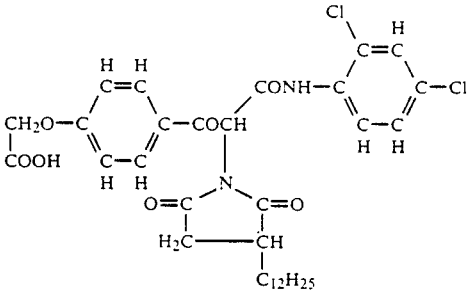
(Y-9)
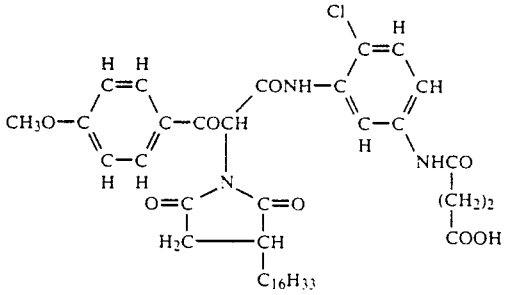
-continued
(Y-10)
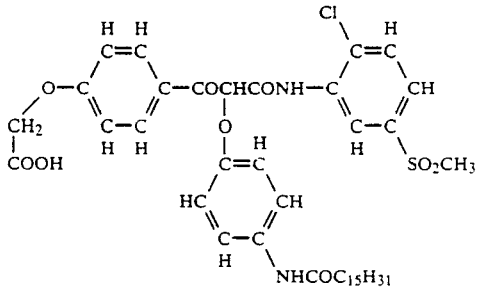
(Y-11)
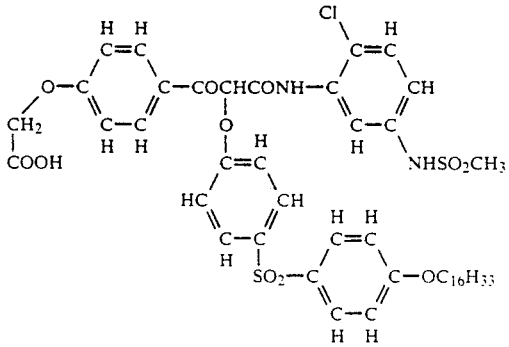
(Y-12)
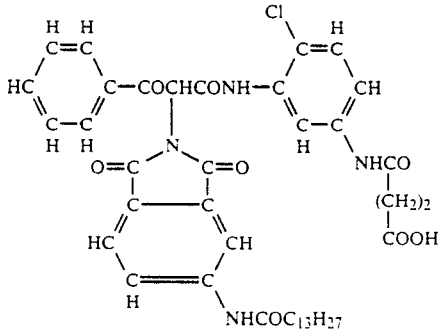
(Y-13)
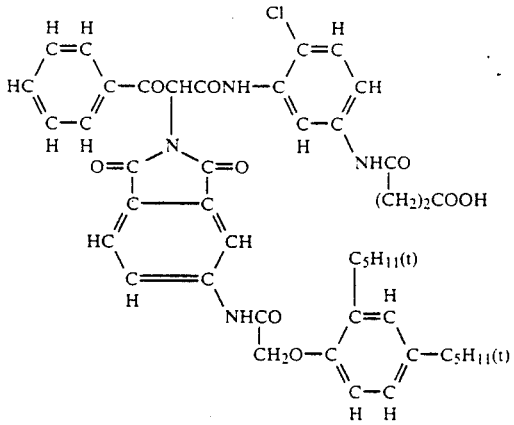
(Y-14)
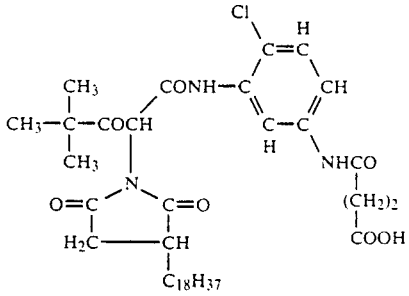

-continued
(Y-15)
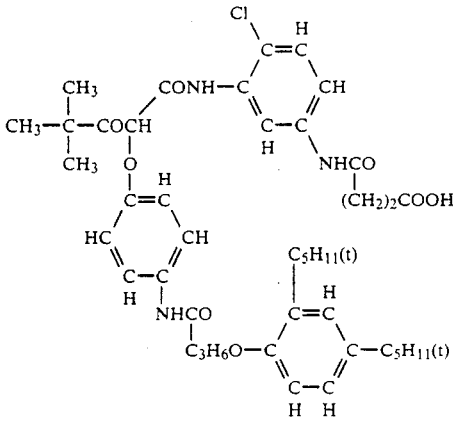
(Y-16)
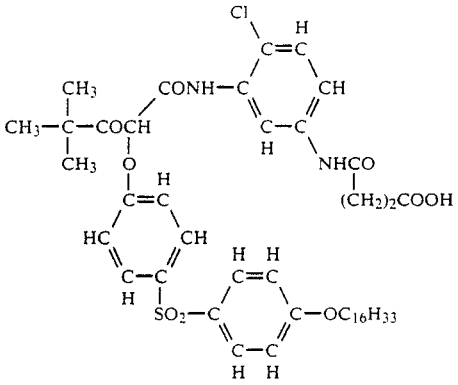
(Y-17)
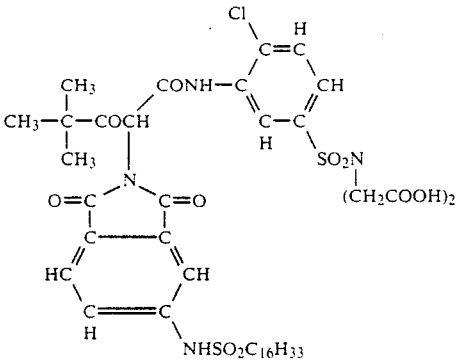
(Y-18)
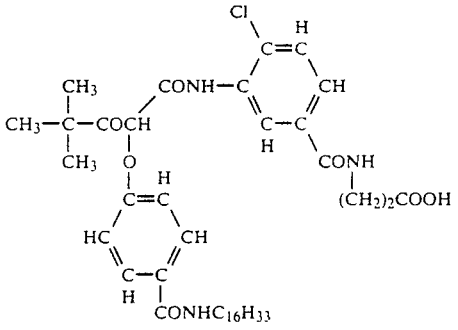
-continued
(Y-19)
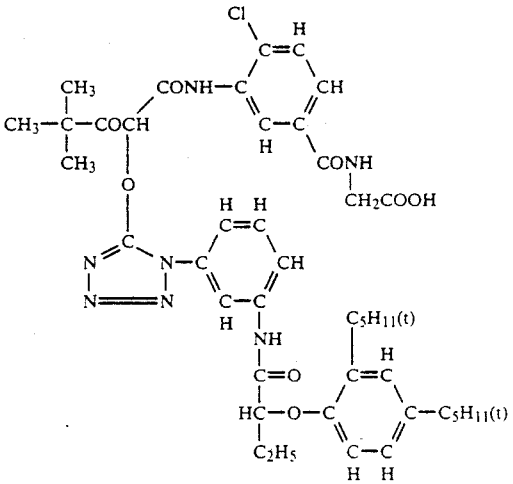
(Y-20)
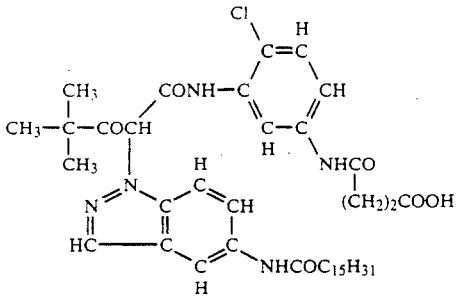
(Y-21)
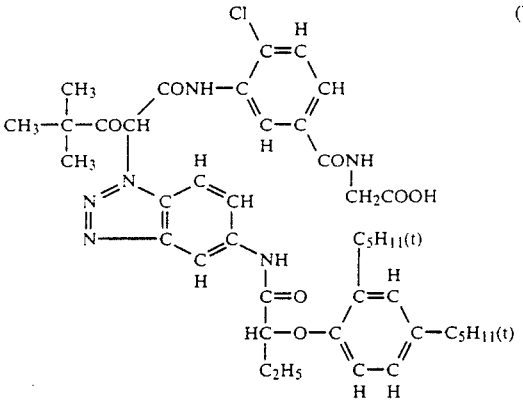
Magenta Coupler

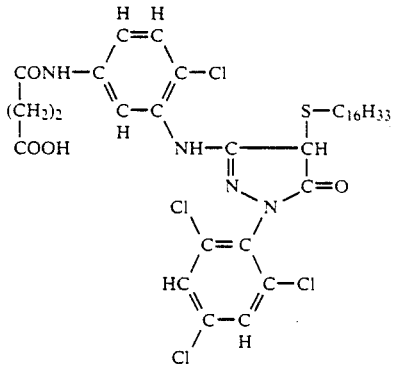
(M-1)
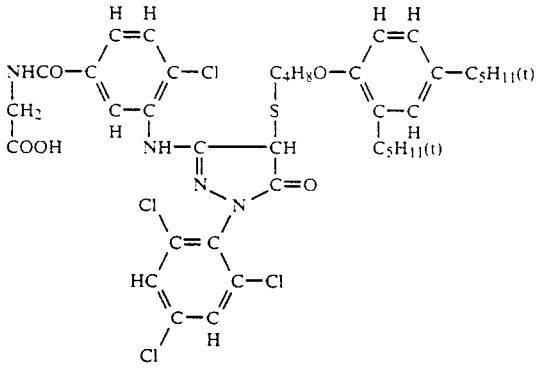
(M-2)
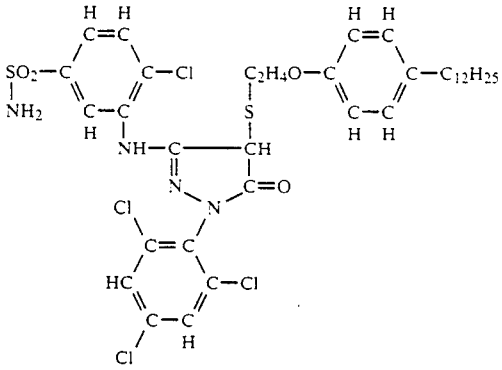
(M-3)
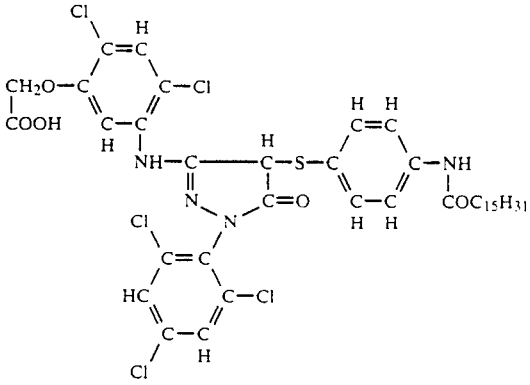
(M-4)

-continued
(M-5)
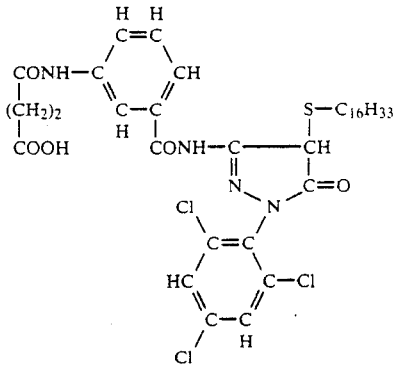
(M-6)
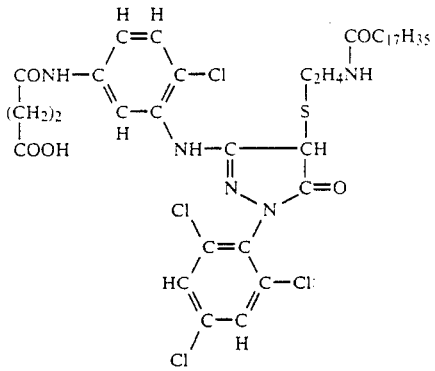
(M-7)
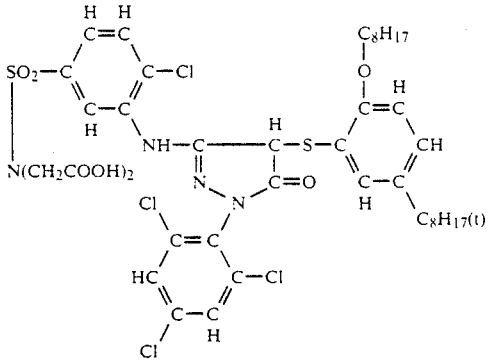
(M-8)
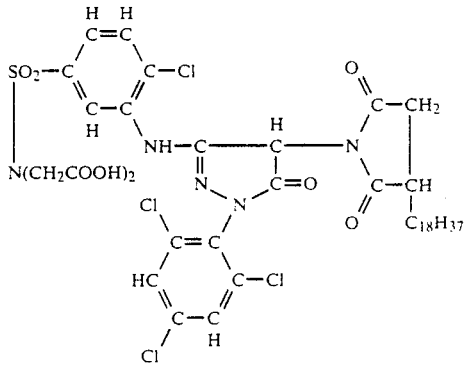

-continued
(M-9)
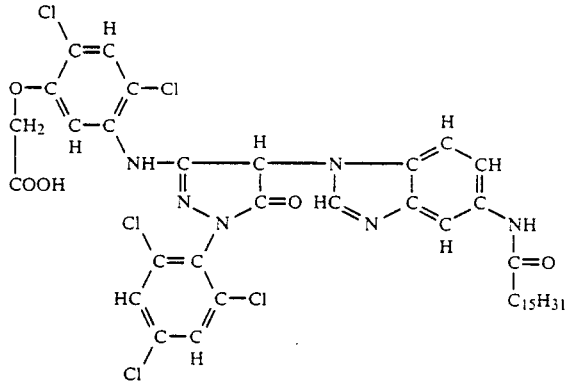
(M-10)
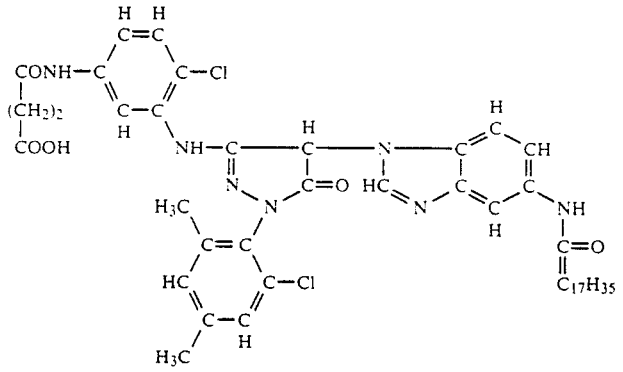
(M-11)
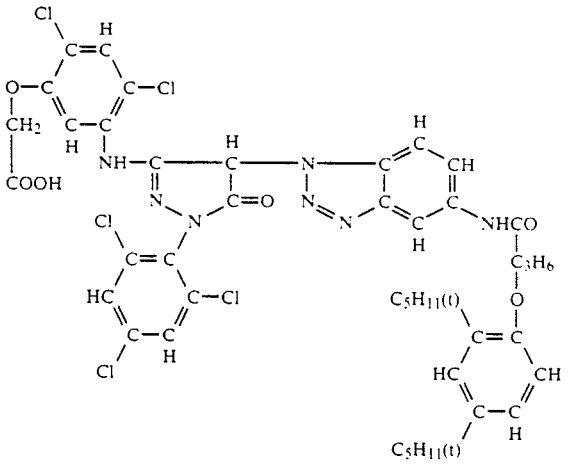
(M-12)
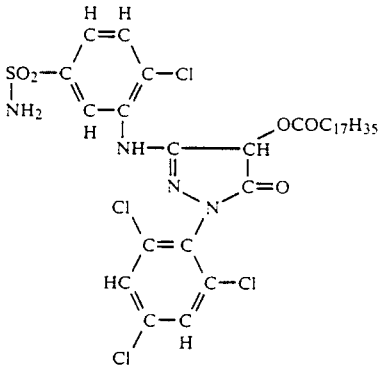

-continued
(M-13)
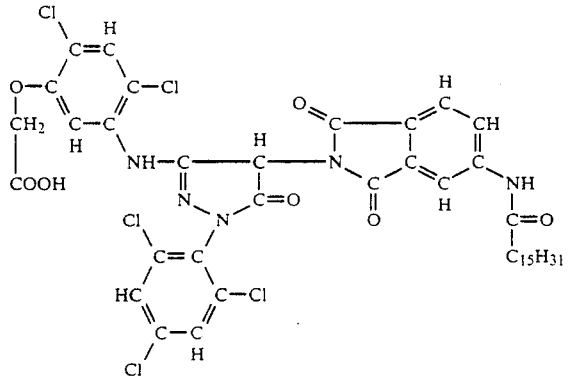
(M-14)
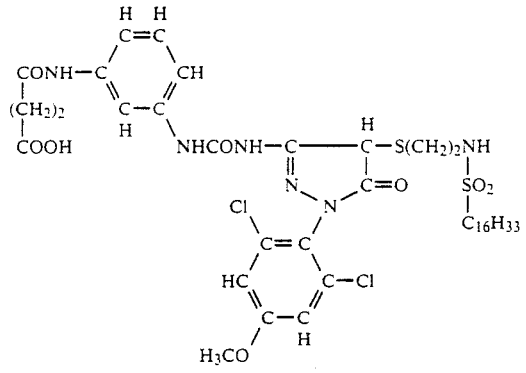
(M-15)
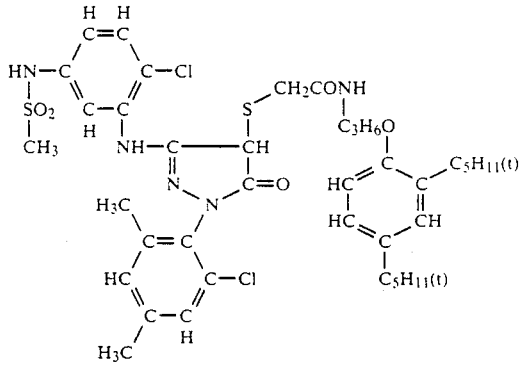
(M-16)
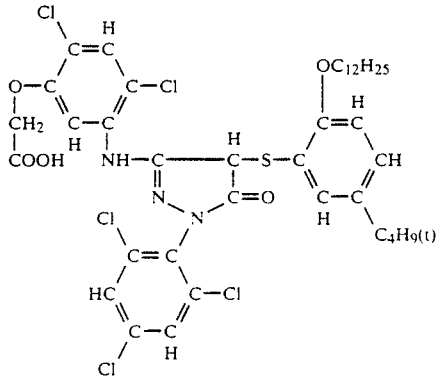

-continued
(M-17)
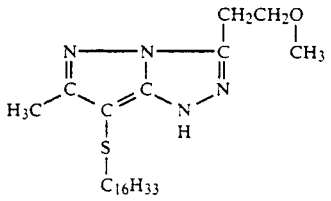
Cyan Coupler
(C-1)
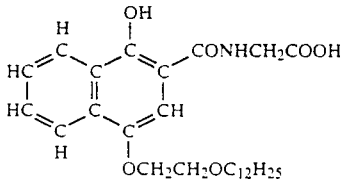
(C-2)
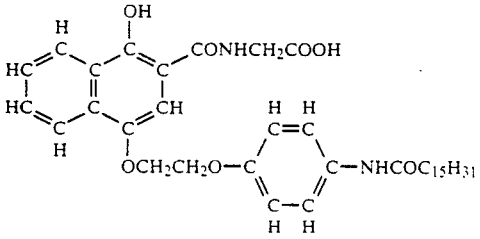
(C-3)
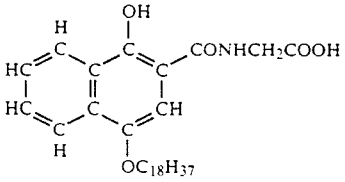
(C-4)
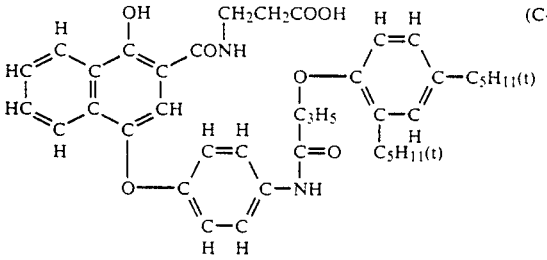
(C-5)
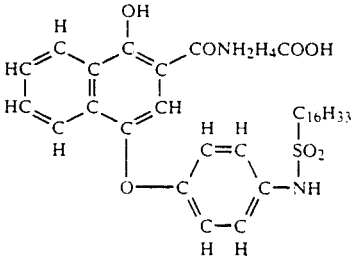
-continued
(C-6)
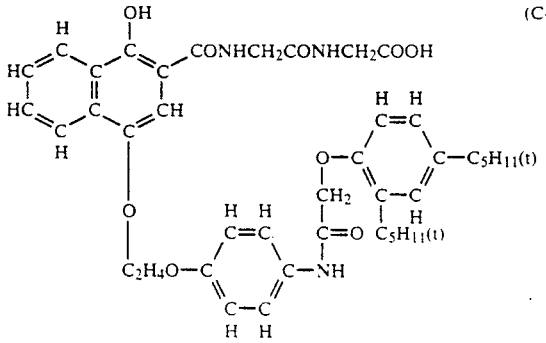
(C-7)
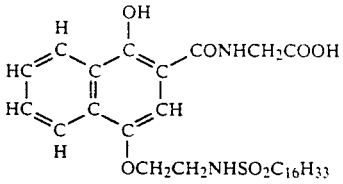
(C-8)
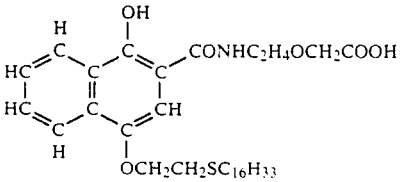
(C-9)
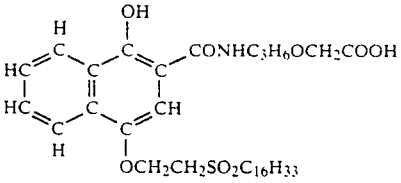
(C-10)
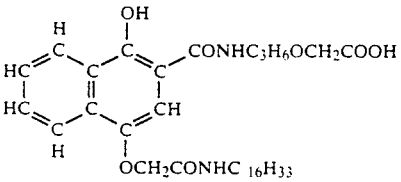
(C-11)
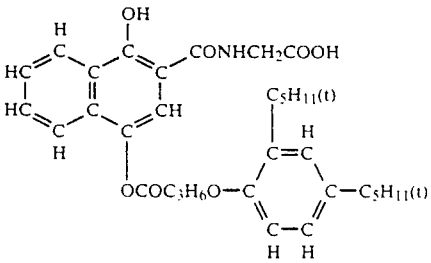

-continued (C-12)

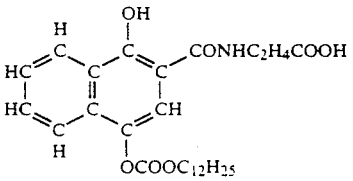

(C-13)

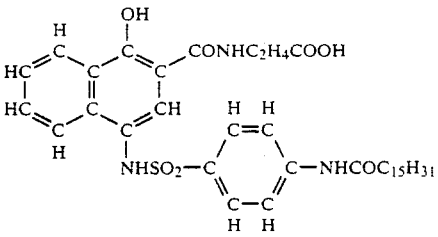

(C-14)

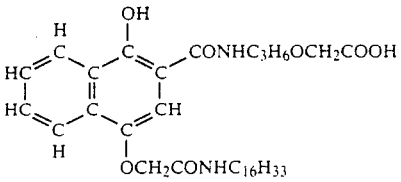

(C-15)

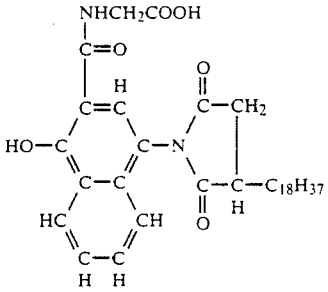

(C-16)

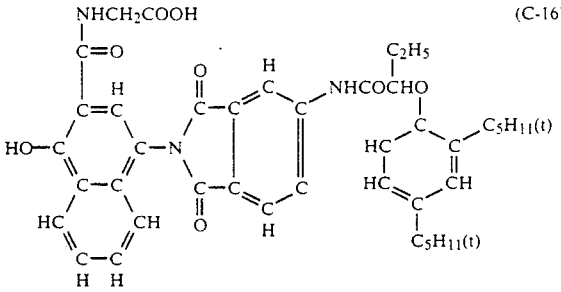

(C-17)

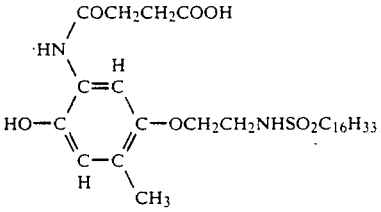

(C-18)

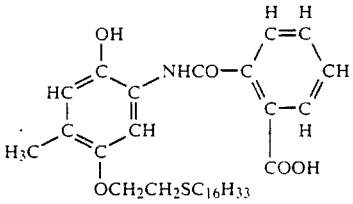

-continued (C-19)

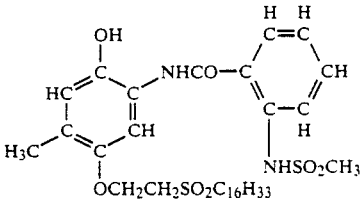

(C-20)

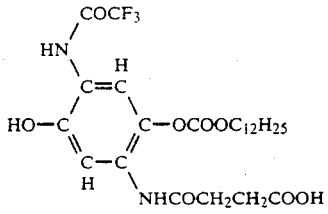

(C-21)

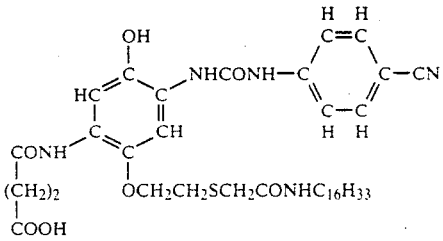

(C-22)

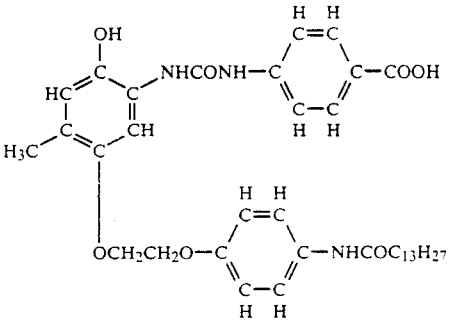

The couplers used in this invention can be prepared by ordinary manners about each of yellow, magenta, and cyan couplers. That is, the yellow coupler can be prepared by reacting an α-acyl-α-halogenoacetamide derivative obtained by halogenating a corresponding 4-equivalent coupler and a corresponding nucleophilic reagent having a non-diffusible group in the presence of a base. The magenta coupler can be prepared by introducing a non-diffusible releasable group into a corresponding 4-equivalent coupler according to known methods as described in, for example, U.S. Pat. Nos. 3,926,631, 4,040,835, 3,227,554, 3,311,476, 3,419,391, etc. Also, various methods are known about the kinds of releasable groups about cyan couplers but, in general, the cyan coupler can be prepared by reacting a hydroxy group or an amino group bonded to a coupling position of a phenol nucleus or naphthol nucleus with a proper electrophilic reagent having a non-diffusible group.

Then, typical examples of producing the couplers of this invention are shown below.

SYNTHESIS EXAMPLE 1

Synthesis of Coupler (Y-8)

A mixture of 37.3 g of α-(4-methoxybenzoyl)-α-chloro-2,4-dichloroacetanilide, 26.7 g of dodecylsuccinic acid imide, 12.9 g of diisopropylethylamine, and 250 ml of acetonitrile was refluxed for 3 hours while heating.

After allowing to cool the mixture, acetonitrile was distilled off under reduced pressure, the residue thus formed was dissolved in a mixture of water and ethyl acetate, and the organic solvent phase thus formed was separated.

After drying the organic solvent phase with anhydrous magnesium sulfate, the solvent was distilled off under reduced pressure, the residue thus formed was crystallized by the addition of methanol, and white crystals of Coupler (Y-8) were collected by filtration. The amount of the product was 38 g.

SYNTHESIS EXAMPLE 2

Synthesis of Coupler (M-2)

2-1. Synthesis of S-[3-(2,4-Dichloroanilino)-1-(2,4,6-trichlorophenyl)-2-pyrazolin-5-one-4-yl]isothiuronium Hydrobromide In 150 ml of N,N-dimethylformamide were dissolved 42.4 g of 3-(2,4-dichloroanilino)-1-(2,4,6- trichlorophenyl)-2-pyrazolin-5-one and 8 g of thiourea and after adding dropwise thereto 19.2 g of bromine, the mixture was stirred at room temperature. The reaction mixture was gradually added to 500 ml of water with stirring and the solids thus precipitated were collected by filtration and dried to provide 53 g of the grayish white solid product.

2-2. Synthesis of Coupler (M-2)

To a solution of 10 g of potassium hydroxide dissolved in 50 ml of methanol was added 20 g of the foregoing isothiuronium salt and after further adding 12 g of 4-(2,4-di-tert-amylphenoxy)butyl chloride to the solution, the resultant mixture was stirred at room temperature. After adding 1 liter of ethyl acetate to the reaction mixture, the mixture was washed with diluted hydrochloric acid and then water, ethyl acetate was distilled off under reduced pressure, and the residue was recrystallized from a mixture of acetonitrile and ethyl acetate to provide 23 g of the desired coupler.

SYNTHESIS EXAMPLE 3

Synthesis of Coupler (C-1)

A mixture of 21.7 g of N-methylamide 1,4-dihydroxy-2-naphthoate, 46 g of ethylene glycol monododecyl ether, 19 g of p-toluenesulfonic acid, and 300 ml of toluene was refluxed with heating for 5 hours while distilling off the solvent.

After allowing to cool the reaction mixture, a solvent was added thereto and an organic solvent phase thus formed was separated. After drying the organic solvent phase with anhydrous magnesium sulfate, the solvent was distilled off under reduced pressure and the residue thus formed was purified by silica gel chromatography (eluent: ethyl acetate/hexane: $\frac{1}{3}$) to provide 24 g of the white crystals of Coupler (C-1).

SYNTHESIS EXAMPLE 4

Synthesis of Coupler (Y-2)

A mixture of 39.5 g of α-(4-methoxybenzoyl)-α-chloro-2-chloro-5-acetylaminoacetanilide, 26.7 g of dodecylsuccinimide, 12.9 g of diisopropylethylamine, and 300 ml of acetonitrile was refluxed for 3 hours while heating.

After allowing to cool the reaction mixture, acetonitrile was distilled off under reduced pressure, the residue thus formed was dissolved in ethyl acetate a solvent was added to the solution, and an organic solvent phase thus formed was separated.

After drying the organic solvent phase with anhydrous magnesium sulfate, the solution was concentrated under reduced pressure, n-hexane was added to the residue to form crystals, and then the white crystals of Coupler (Y-2) were collected by filtration. The amount of the product was 36.5 g.

SYNTHESIS EXAMPLE 5

Synthesis of Coupler (M-5)

5-1. Synthesis of S-[3-(2-Chloro-5-acetylaminoanilino)- 1-(2,4,6-trichlorophenyl)-2-pyrazolin-5-one-4-yl]-isothiuronium Hydrobromide In 150 ml of N,N-dimethylformamide were dissolved 44.6 g of 3-(2-chloro-5-acetylaminoanilino)- 1-(2,4,6-trichlorophenyl)-2-pyrazolin-5-one and 8 g of thiourea and then 19.2 g of bromine was added dropwise to the solution at room temperature with stirring. After further stirring the mixture for 30 minutes at room temperature, the reaction mixture was gradually added to cold water. Solids thus precipitated were collected by filtration and dried to provide 56 g of the isothiuronium salt.

5-2. Synthesis of Coupler (M-5)

To 50 ml of methanol containing 10 g of potassium hydroxide was added 20 g of the foregoing isothiuronium salt and then after adding thereto 11 g of hexadecyl bromide, the mixture was stirred for 2 hours at room temperature. After adding thereto 1 liter of ethyl acetate, the mixture was washed with diluted hydrochloric acid and then water and after drying with anhydrous magnesium sulfate, ethyl acetate was distilled off under reduced pressure. Then, the residue thus formed was recrystallized from acetonitrile to provide the white crystals of Coupler (M-5).

SYNTHESIS EXAMPLE 6

Synthesis of Coupler (C-2)

A mixture of 44.5 g of phenyl 1-hydroxy-4-(4- nitrophenoxyethoxy)-2-naphthoate, 9 g of 2-methoxyethyl, and 100 ml of N,N-dimethylformamide was heated on a hot water bath for 3 hours. After allowing to cool the reaction mixture, to cold diluted hydrochloric acid was added the reaction mixture and the precipitates thus formed were collected by filtration and washed with water. The amount of the product was 39 g.

A mixture of 21.3 g of the precipitates thus obtained, 20 g of active iron, 1.5 g of ammonium chloride, 200 ml of isopropanol, and 20 ml of water was refluxed with heating for 3 hours while stirring vigorously. At hot, the reaction mixture was filtered from cerite and the filtrate was concentrated under reduced pressure. After allowing to cool the concentrate, the light brown crystals thus precipitated were collected by filtration and washed with water to provide 14 g of the amine compound.

A mixture of 8 g of the amine compound, 8.3 g of palmitic acid chloride, and 30 ml of acetonitrile was refluxed with heating for 2 hours. After allowing to cool the reaction mixture, the crystals thus precipitated were collected by filtration and recrystallized from ethyl acetate to provide 10.4 g of white crystals of Coupler (C-2).

SYNTHESIS EXAMPLE 7

Synthesis of Coupler (C-13)

In a mixture of 50 ml of N,N-dimethylacetamide, 30 ml of tetrahydrofuran, and 20 ml of pyridine was dissolved 23 g of 4-amino-2-N-ethylcarbamoyl-1-naphthol and then 47.5 g of 4-hexadecanoylaminobenzene sulfonyl chloride was added to the solution little by little. After stirring the mixture for 30 minutes at room temperature, to cold diluted hydrochloric acid was added the reaction mixture and precipitates thus formed were collected by filtration and washed with water to provide a crude product. The crude product was recrystallized from ethyl acetate to provide 46 g of light brown crystals of Coupler (C-13).

SYNTHESIS EXAMPLE 8

Synthesis of Coupler (Y-6)

A mixture of 39.5 g of α-(4-methoxybenzoyl)-α-chloro-2-chloro-5-acetylaminoacetanilide, 47.4 g of bisphenol S-monohexadecyl ether, 12.9 g of diisopropylethylamine, and 250 ml of acetonitrile was refluxed with heating for 5 hours. After allowing to cool the mixture, acetonitrile was distilled off under reduced pressure, the residue thus formed was dissolved in ethyl acetate and a solvent, and the organic solvent phase thus formed was separated. After drying the organic solvent phase with anhydrous magnesium sulfate, the solvent was distilled off under reduced pressure, methanol was added to the residue to form crystals, and the white crystals of Coupler (Y-6) thus formed were collected by filtration. The amount of the product was 56 g.

The coupler of this invention can be used in a definite range of concentration. In general, a useful concentration range of the coupler is about 0.01 mol to about 4 mols per mol of silver. A particularly preferred concentration of the coupler of this invention for obtaining the effect of this invention is about 0.05 mol to about 1 mol per mol of silver.

The silver halide used in this invention includes silver chloride, silver chlorobromide, silver chloroiodide, silver bromide, silver iodobromide, silver chloroiodobromide and silver iodide, etc.

In the embodiment of this invention in which the organic silver salt oxidizing agent is not used together with but the silver halide is used alone, particularly preferred silver halide is silver halide partially containing a silver iodide crystal in its particle. That is, the silver halide the X-ray diffraction pattern of which shows that of pure silver iodide is particularly preferred.

In photographic light-sensitive materials a silver halide containing two or more kinds of halogen atoms can be used. Such a silver halide yields a completely mixed crystal in a conventional silver halide emulsion. For example, the particle of silver iodobromide shows X-ray diffraction pattern at a position corresponding to the mixed ratio of silver iodide crystal and silver bromide crystal but not at a position corresponding to pure silver iodide crystal and pure silver bromide crystal separately.

Particularly preferred examples of silver halide used in this invention include silver chloroiodide, silver iodobromide, and silver chloroiodobromide each containing silver iodide crystal in its particle and showing X-ray diffraction pattern of silver iodide crystal.

The process for preparing those silver halides is explained taking the case of silver iodobromide. That is, the silver iodobromide is prepared by first adding silver nitrate solution to potassium bromide solution to form silver bromide particles and then adding potassium iodide to the mixture.

Two or more kinds of silver halides in which a particle size and/or a halogen composition are different from each other may be used in mixture.

An average particle size of the silver halide used in this invention is preferably from 0.001 μm to 10 μm and more preferably from 0.001 μm to 5 μm.

The silver halide used in this invention may be used as it is. However, it may be chemically sensitized with a chemical sensitizing agent such as compounds of sulfur, selenium or tellurium, etc., or compounds of gold, platinum, palladium, rhodium or iridium, etc., a reducing agent such as tin halide, etc., or a combination thereof. The details thereof are described in T.H. James, *The Theory of the Photographic Process*, the Fourth Edition, Chapter 5, pages 149 to 169.

In the embodiment of this invention, an organic silver salt oxidizing agent is used together. The silver halide used in this case is not always necessary to have the characteristic in that the silver halide contains pure silver iodide crystal in the case of using the silver halide alone. Any silver halide which is known in the art can be used.

In this invention, a light-sensitive material which provides higher color density can be obtained by the coexistence of the organic silver salt oxidizing agent. Accordingly, it is a preferred embodiment of this invention to use the organic silver salt oxidizing agent.

The organic silver salt oxidizing agent is a silver salt which forms a silver image by reacting with the coexisting reducing agent, when it is heated to a temperature of above 80° C. and, preferably, above 100° C. in the presence of exposed silver halide. A silver salt of an organic compound having a carboxy group can be used as an example of the organic silver salt oxidizing agent. Typical examples thereof include a silver salt of an aliphatic carboxylic acid and a silver salt of an aromatic carboxylic acid.

Examples of the silver salts of aliphatic carboxylic acids include silver behenate, silver stearate, silver oleate, silver laurate, silver caprate, silver myristate, silver palmitate, silver maleate, silver fumarate, silver tartarate, silver furoate, silver linolate, silver oleate, silver adipate, silver sebacate, silver succinate, silver acetate, silver butyrate and silver comphorate, etc. These silver salts which are substituted with a halogen atom or a hydroxy group are also effectively used.

Examples of the silver salts of aromatic carboxylic acid and other carboxyl group containing compounds include silver benzoate, a silver substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellitate, a silver salt of 3-carboxymethyl-4- methyl-4-thiazoline-2-thione, etc., as described in U.S. Pat. No. 3,785,830, and a silver salt of an aliphatic carboxylic acid containing a thioether group as described in U.S. Pat. No. 3,330,663, etc.

In addition, a silver salt of a compound containing a mercapto group or a thione group and a derivative thereof can be used.

Examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-mercaptobenzothiazole, a silver salt of 2-(S-ethylglycolamido)benzothiazole, a silver salt of thioglycolic acid such as a silver salt of an S-alkyl thioglycol acetic acid (wherein the alkyl group has from 12 to 22 carbon atoms) as described in Japanese Patent Application (OPI) No. 28221/73, a silver salt of dithiocarboxylic acid such as a silver salt of dithioacetic acid, a silver salt of thioamide, a silver salt of 5-carboxyl-1-methyl-2-phenyl-4-thiopyridine, a silver salt of mercaptotriazine, a silver salt of 2-mercaptobenzoxazole, a silver salt of mercaptooxadiazole, a silver salt as described in U.S. Pat. No. 4,123,274, for example, a silver salt of 1,2,4-mercaptotriazole derivative such as a silver salt of 3-amino-5-benzylthio-1,2,4-triazole, a silver salt of thione compound such as a silver salt of 3-(2-carboxyethyl)-4-methyl-4-thiazoline-2-thione as described in U.S. Pat. No. 3,301,678, and the like.

Further, a silver salt of a compound containing an imino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Moreover, a silver salt as described in *Research Disclosure*, Vol. 170, No. 17029 (June, 1978) and an organic metal salt such as copper stearate, etc., also can be used in this invention as well as the abovedescribed organic silver salt oxidizing agent.

Two or more of organic silver salt oxidizing agents can be used together.

It is preferred that the reducing agent used in this invention has a faculty of being oxidized by a silver halide and/or an organic silver salt oxidizing agent and forming a dye by the reaction of the oxidation product thereof and the non-diffusible 2-equivalent coupler of this invention. As the reducing agent having such a faculty, a color developing agent forming an image by oxidative coupling is preferred.

As an example of the reducing agent used for heat developable color photographic material, there are p-phenylenediamine series color developing agents typified by, for example, N,N-diethyl-3-methyl-p-phenylenediamine as described in U.S. Pat. No. 3,531,286. As more useful reducing agents, there are aminophenols described in U.S. Pat. No. 3,761,270. Among these aminophenol reducing agents, particularly preferred ones are 4-amino-2,6-dichlorophenol, 4-amino-2-methylphenol sulfate, 4-amino-3-methylphenol sulfate, 4-amino-2,6-dichlorophenol hydrochloride, etc.

Furthermore, 2,6-dichloro-4-substituted sulfonamidophenol, 2,6-dibromo-4-substituted sulfonamidophenol, etc., are described in *Research Disclosure*, Vol. 151, No. 15108 and U.S. Pat. No. 4,021,240 and these compounds are also useful as the reducing agents in this invention.

In addition to the foregoing phenolic reducing agents, naphtholic reducing agents such as 4-amino-1-naphthol derivatives and 4-substituted sulfonamido-1-naphthol derivatives are also useful as the reducing agents.

Moreover, examples of the general reducing agents used in this invention are the aminohydroxypyrazole derivatives described in U.S. Pat. No. 2,895,825, the aminopyrazoline derivatives described in U.S. Pat. No. 2,892,714, and the hydrazone derivatives described in *Research Disclosure*, June 1980, pages 227–230 and pages 236–240 (RD-19413 and RD-19415).

Among the foregoing various reducing agents, the reducing agents having a hydrophilic group (e.g., an $-SO_3^-$group, a $-COO^-$group, an $-OH$ group, an $-SONH_2$ group, a $-CONH_2$ etc.) are preferably used. These reducing agents may be used solely or as a combination of two or more kinds.

In this invention, the following reducing agents can be used as auxiliary developing agent in addition to the foregoing reducing agents.

Examples of useful auxiliary developing agents include hydroquinone, alkyl substituted hydroquinones such as tertiary butylhydroquinone, 2,5-dimethylhydroquinone, etc., catechols, pyrogallols, halogen substituted hydroquinones such as chlorohydroquinone, dichlorohydroquinone, etc., alkoxy substituted hydroquinones such as methoxyhydroquinone, and polyhydroxybenzene derivatives such as methyl hydroxynaphthalene, etc. Further, methyl gallate, ascorbic acid, ascorbic acid derivatives, hydroxylamines such as N,N-di(2-ethoxyethyl)hydroxylamine, etc., pyrazolidones such as 1-phenyl-3-pyrazolidone, 4-methyl-4-hydroxymethyl-1-phenyl-3-pyrazolidone, etc., reductones and hydroxy tetronic acids are useful.

The amount of the reducing agent used for the coupling reaction with the 2-equivalent coupler in this invention is about 0.1 mol to about 20 mols, preferably about 0.1 mol to about 4 mols per mol of the 2-equivalent coupler used in this invention.

Also, the auxiliary developing agent can be used in a definite concentration range. The useful concentration range of the auxiliary developing agent is 0.0005 mol times to 20 mol times, particularly 0.001 mol times to 4 mol times the amount of silver.

The heat developing mechanism of the heat developable color light-sensitive material of this invention has not yet been clarified but may be considered to be as follows.

That is, when the light-sensitive material is exposed to light, a latent image is formed on the light-sensitive silver halide, which is described in, for example, T.H. James, *The Theory of the Photographic Process*, 3rd Edition, pages 105–148.

Then, by heating the light-sensitive material thus light-exposed, the reducing agent reduces the silver halide and/or the organic silver salt oxidizing agent with the latent image nuclei as a catalyst to form silver and the reducing agent itself is oxidized. The oxidized product of reducing agent reacts with the non-diffusible 2-equivalent coupler (so-called oxidative coupling) to form a dye.

In the case of using the silver halide and the organic silver-salt oxidizing agent in the light-sensitive material, it is necessary for initiating the reaction quickly that the silver halide and the organic silver salt oxidizing agent exist within a substantially effective interval and hence it is desirable that the silver halide and the organic silver salt oxidizing agent exist in a same layer.

In general, a heat development requires a relatively long period of time for completing the development reaction since the diffusion of reaction molecules is restrained, which is different from a so-called wet development. However, if heating for development is performed for a long time, the heat reaction at unexposure areas of a light-sensitive material cannot be ignored to form so-called fog and hence long time heating is undesirable.

In this invention, a thermal solvent can be used as a means for overcoming such a difficulty. By the term "thermal solvent" is meant a non-hydrolyzable organic material which is solid at an ambient temperature but melts together with other components at a temperature of heat treatment or below. When a heat developable light-sensitive material is developed by heating in the presence of the thermal solvent, the development can be accelerated to improve the image quality formed. The role of the thermal solvent in this case is not-always clear but it is considered that the main role is to promote the diffusion of reaction molecules at development.

Examples of preferred thermal solvents used in the present invention include a compound capable of being used as a solvent for developing agent, a compound that is known as a substance having a high dielectric constant and accelerating a physical development of silver salt, or etc.

Examples of preferred thermal solvents include polyglycols as described in U.S. Pat. No. 3,347,675, for example, polyethylene glycol having an average molecular weight of 1,500 to 20,000, derivatives of polyethylene oxide such as polyethylene oxide oleic acid ester, etc., beeswax, monostearin, compounds having a high dielectric constant which have an —$SO_2$— or —CO— group such as acetamide, succinimide, ethylcarbamate, urea, methylsulfonamide or ethylene carbonate, polar substances as described in U.S. Pat. No. 3,667,959, lactone of 4-hydroxybutanoic acid, methylsulfinylmethane, tetrahydrothiophene-1,1-dioxide, and 1,10-decanediol, methyl anisate and biphenyl suberate as described in *Research Disclosure*, pages 26 to 28 (Dec., 1976), etc.

The light-sensitive silver halide and the organic silver salt oxidizing agent used in this invention are prepared in the binders described hereinafter. Also, the non-diffusible 2-equivalent coupler is dispersed in the binder by a proper method.

The foregoing coupler used in this invention can be dispersed into the binder by known methods such as a method as described in U.S. Pat. No. 2,322,027. In this case, an organic solvent having a high boiling point or an organic solvent having a low boiling point as described below can be used. For example, the coupler is dispersed in a hydrophilic colloid after dissolved in an organic solvent having a high boiling point, for example, a phthalic acid alkyl ester (for example, dibutyl phthalate, dioctyl phthalate, etc.), a phosphopic acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), an aliphatic acid ester (for example, dibutoxyethyl succinate, dioctyl azelate, etc.), etc., or an organic solvent having a boiling point of about 30° C. to 150° C., for example, a lower alkyl acetate such as ethyl acetate, butyl acetate, etc., ethyl propionate, secondary butyl alcohol, methyl isobutyl ketone, β-ethoxyethyl acetate, methyl cellosolve acetate, etc. The above-described organic solvents having a high boiling point and organic solvents having a low boiling point may be used as a mixture thereof.

In the foregoing dispersion method, several kinds of couplers may be separately dispersed in each organic solvent as fine particles thereof and then the dispersions may be incorporated in a silver halide emulsion or several kinds of couplers may be simultaneously dispersed in an organic solvent and then the dispersion may be incorporated in a silver halide emulsion.

The binder which can be used in this invention can be employed individually or in a combination thereof. A hydrophilic binder can be used as the binder according to this invention. The typical hydrophilic binder is a transparent or translucent hydrophilic colloid, examples of which include a natural substance, for example, protein such as gelatin, a gelatin derivative, a cellulose derivative, etc., a polysaccharide such as starch, gum arabic, pullulan, dextrin, etc., and a synthetic polymer, for example, a water-soluble polyvinyl compound such as polyvinyl alcohol, polyvinyl pyrrolidone, acrylamide polymer, etc. Another example of the synthetic polymer compound is a dispersed vinyl compound in a latex-form which is used for the purpose of increasing dimensional stability of a photographic material.

In this invention, various bases or base precursors may be incorporated in the layers of light-sensitive materials or in the layers of dye-fixing materials by any desired method. For obtaining a desired dye image at lower temperatures in this invention, it is particularly advantageous to use these bases or base precursors and in the case of using these substances in, in particular, light-sensitive materials, it is necessary to select the substances which do not reduce the shelf life of the light-sensitive materials.

Examples of preferred bases are amines which include trialkylamines, hydroxylamines, aliphatic polyamines, N-alkyl substituted aromatic amines, N-hydroxyalkyl substituted aromatic amines and bis[p-(dialkylamino)phenyl]methanes. Further, there are betaine tetramethylammonium iodide and diaminobutane dihydrochloride as described in U.S. Pat. No. 2,410,644, and urea and organic compounds including amino acids such as 6-aminocaproic acid as described in U.S. Pat. No. 3,506,444. The base precursor is a substance which releases a basic component by heating thereby to activate light-sensitive material. Examples of typical base precursors are described in British Patent 998,949. A preferred base precursor is a salt of a carboxylic acid and an organic base, and examples of the preferred carboxylic acids include trichloroacetic acid and trifluoroacetic acid and examples of the preferred bases include guanidine, piperidine, morpholine, p-toluidine and 2-picoline, etc. Guanidine trichloroacetate as described in U.S. Pat. No. 3,220,846 is particularly preferred. Further, aldonic amides as described in Japanese Patent Application (OPI) No. 22625/75 are preferably used because they decompose at a high temperature to form bases.

These bases or base precursors can be used in an amount of a broad range. A useful range is up to 50% by weight based on the amount of a dry layer coated of the light-sensitive material. A range of 0.01% by weight to 40% by weight is more preferred.

It is advantageous to use a compound represented by the general formula described below in the heat developable color light-sensitive material in order to accelerate development.

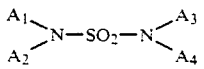

(A)

wherein $A_1$, $A_2$, $A_3$ and $A_4$, which may be the same or different, each represents a hydrogen atom or a substituent selected from an alkyl group, a substituted alkyl group, a cycloalkyl group, an aralkyl group, an aryl group, a substituted aryl group and a heterocyclic group; and $A_1$ and $A_2$ or $A_3$ and $A_4$ may combine with each other to form a ring.

Specific examples of the compounds include $H_2NSO_2NH_2$, $H_2NSO_2N(CH_3)_2$, $H_2NSO_2N(C_2H_5)_2$, $H_2NSO_2NHCH_3$, $H_2NSO_2N(C_2H_4OH)_2$, $CH_3NHSO_2NHCH_3$,

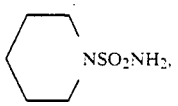

etc.

The above described compound can be used in an amount of broad range. A useful range is up to 20% by weight based on the amount of a dry layer coated of the light-sensitive material. A range of 0.1% by weight to 15% by weight is more preferred.

The silver halide used in this invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful. Any conventionally utilized nucleus for cyanine dyes, such as basic heterocyclic nuclei, is applicable to these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei may also be substituted.

To merocyanine dyes and complex merocyanine dyes, as nuclei having a ketomethylene structure, 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be applicable.

Useful sensitizing dyes include those described in German Patent 929,080, U.S. Pat. Nos. 2,231,658, 2,493,748, 2,503,776, 2,519,001, 2,912,329, 3,656,959, 3,672,897, 3,694,217, 4,025,349 and 4,046,572, British Patent 1,242,588, Japanese Patent Publication Nos. 14030/69 and 24844/77, etc.

These sensitizing dyes can be employed individually, and can also be employed in combination thereof. A combination of sensitizing dyes is often used, particularly for the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Patents 1,344,281 and 1,507,803, Japanese Patent Publication Nos. 4936/68 and 12375/78, Japanese Patent Application (OPI) Nos. 110618/77 and 109925/77, etc.

The sensitizing dyes may be present in the emulsion together with dyes which themselves do not give rise to spectrally sensitizing effects but exhibit a supersensitizing effect or materials which do not substantially absorb visible light but exhibit a supersensitizing effect. For example, aminostilbene compounds substituted with a nitrogen-containing heterocyclic group (e.g., those described in U.S. Pat. No. 2,933,390 and 3,635,721), aromatic organic acid-formaldehyde condensates (e.g., those described in U.S. Pat. No. 3,743,510), cadmium salts, azaindene compounds, etc., can be present. The combinations described in U.S. Pat. Nos. 3,615,613, 3,615,641, 3,617,295 and 3,635,721 are particularly useful.

A support used in the light-sensitive material and the dye fixing material employed according to this invention is that which can endure at the processing temperature. As an ordinary support, not only glass, paper, metal or analogues thereof may be used, but also an acetyl cellulose film, a cellulose ester film, a polyvinyl acetal film, a polystyrene film, a polycarbonate film, a polyethylene terephthalate film, and a film related thereto or a plastic material may be used. The polyesters described in U.S. Pat. Nos. 3,634,089 and 3,725,070 are preferably used. The polyethylene terephthalate film is particularly preferably used.

The coating composition used in this invention may be prepared by mixing before use a silver halide and an organic metal salt oxidizing agent each prepared separately or may be prepared by mixing both the components by a ball mill for a long period of time. Also, a process of adding a halogen-containing compound to an organic silver salt oxidizing agent, and forming silver halide by the silver in the organic metal salt oxidizing agent and the halogen of the halogen-containing compound is effectively employed in this invention.

Methods of preparing these silver halide and organic silver salt oxidizing agents and manners of blending them are described in *Research Disclosure*, No. 17029, Japanese Patent Application (OPI) Nos. 32928/75 and 42529/76, U.S. Pat. No. 3,700,458, and Japanese Patent Application (OPI) Nos. 13224/74 and 17216/75.

A suitable coating amount of the light-sensitive silver halide and the organic silver salt oxidizing agent employed in the present invention is in a total of from 50 $mg/m^2$ to 10 $g/m^2$ calculated as an amount of silver.

The photographic emulsion layer and other hydrophilic colloid layers in the light-sensitive material of this invention may contain various surface active agents for various purposes, for example, as improvement of lubricating property, emulsification, prevention of adhesion, improvement of photographic properties (for example, acceleration of development, rendering hard tone or sensitization), etc.

For example, it is possible to use nonionic surface active agents such as saponin (steroid), alkylene oxide derivatives (for example, polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamine or amides, polyethylene oxide adducts of silicone, etc.), glycidol derivatives (for example, alkenylsuccinic acid polyglycerides, alkylphenol polyglycerides, etc.), polyhydric alcohol aliphatic acid esters or saccharide alkyl esters, etc.; anionic surface active agents containing acid groups such as a carboxy group, a sulfo group, a phospho group, a sulfate group, a phosphate group, etc., such as alkylcarboxylic acid salts, alkylsulfonic acid salts, alkylbenzenesulfonic acid salts, alkylnaphthalenesulfonic acid salts, alkyl sulfuric acid esters, alkylphosphoric acid esters, N-acyl-N-alkyltaurines, sulfosuccinic acid esters, sulfoalkyl polyoxyethylene alkylphenyl ethers, polyoxyethylene alkylphosphoric acid esters, etc.; ampholytic surface active agents such as amino acids, aminoalkylsulfonic acids, aminoalkylsulfuric acid esters or phosphoric acid esters, alkylbetaines, amine oxides, etc.; and cationic surface active agents such as alkylamine salts, alipahtic or aromatic quaternary ammonium salts, heterocyclic quaternary ammonium salts such as pyridinium salts, imidazolium salts, etc., aliphatic or heterocyclic phosphonium salts; aliphatic or heterocyclic sulfonium salts, etc.

Of the above-described surface active agents, polyethylene glycol type nonionic surface active agents having a recurring unit of ethylene oxide in their molecules may be preferably incorporated into the light-sensitive material It is particularly preferred that the molecule contains 5 or more of the recurring units of ethylene oxide.

The nonionic surface active agents capable of satisfying the above-described conditions are well known as to their structures, properties and methods of synthesis. These nonionic surface active agents are widely used even outside this field. Representative references relating to these agents include: *Surfactant Science Series,* Vol. 1, Nonionic Surfactants (edited by Martin J. Schick, Marcel Dekker Inc., 1967), and *Surface Active Ethylene Oxide Adducts* (edited by Schoufeldt N. Pergamon Press, 1969). Among the nonionic surface active agents described in the above-mentioned references, those capable of satisfying the above-described conditions are preferably employed in connection with this invention.

The nonionic surface active agents can be used individually or as a mixture of two or more of them.

The polyethylene glycol type nonionic surface active agents can be used in an amount of less than 100% by weight, preferably less than 50% by weight, based on a hydrophilic binder.

The light-sensitive material of this invention may contain a cationic compound containing a pyridinium salt. Examples of the cationic compounds containing a pyridinium group used are described in PSA Journal Section B 36 (1953), U.S. Pat. Nos. 2,648,604 and 3,671,247, Japanese Patent Publication Nos. 30074/69 and 9503/69, etc.

Further, in this invention, it is possible to use a compound which activates development simultaneously while stabilizing the image. Particularly, it is preferred to use isothiuroniums including 2-hydroxyethylisothiuronium trichloroacetate as described in U.S. Pat. No. 3,301,678, bisisothiuroniums including 1,8-(3,6-dioxaoctane)-bis(isothiuronium trifluoroacetate), etc., as described in U.S. Pat. No. 3,669,670, thiol compounds as described in German Patent Application (OLS) No. 2,162,714, thiazolium compounds such as 2-amino-2-thiazolium.trichloroacetate, 2-amino-5-bromoethyl-2thiazolium.trichloroacetate, etc., as described in U.S. Pat. No. 4,012,260, compounds having α-sulfonylacetate as an acid part such as bis(2-amino-2-thiazolium)-methylenebis(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

In this invention, though it is not so necessary to further incorporate substances or dyes for preventing irradiation or halation in the light-sensitive material, it is possible to add filter dyes or light absorbing materials, etc., as described in Japanese Patent Publication No. 3692/73 and U.S. Pat. Nos. 3,253,921, 2,527,583 and 2,956,879, etc., in order to further improve sharpness. It is preferred that these dyes have a thermal bleaching property For example, dyes as described in U.S. Pat. Nos. 3,769,019, 3,745,009 and 3,615,432 are preferred.

The light-sensitive material used in this invention may contain, if necessary, various additives known for the heat developable light-sensitive materials and may have a layer other than the light-sensitive layer, for example, an antistatic layer, an electrically conductive layer, a protective layer, an inter layer, an antihalation layer, a strippable layer, etc.

Examples of various additives include those described in *Research Disclosure,* Vol. 170, No. 17029 (June, 1978), for example, plasticizers, dyes for improving sharpness, antihalation dyes, sensitizing dyes, matting agents, fluorescent whitening agents and fading preventing agent, etc.

The protective layer, the inter layer, the subbing layer, the backing layer and other layers can be produced by preparing each coating solution and applying to a support by various coating methods such as a dip coating method, an air-knife coating method, a curtain coating method or a hopper coating method as described in U.S. Pat. No. 2,681,294 and drying in the same manner as used in preparing the heat developable light-sensitive layer of this invention, by which the light-sensitive material is obtained.

If necessary, two or more layers may be applied at the same time by the method as described in U.S. Pat. No. 2,761,791 and British Patent 837,095.

In this invention, after or simultaneously with the heat developable color light-sensitive material is exposed to light, the resulting latent image can be developed by heating the whole material to a suitably elevated temperature, for example, about 80° C. to about 50° C. for about 0.5 second to about 300 seconds. A higher temperature or lower temperature can be utilized to prolong or shorten the heating time, if it is within the above-described temperature range. Particularly, a temperature range of about 110° C. to about 160° C. is useful As the heating means, a simple heat plate, iron, heat roller, heat generator utilizing carbon or titanium white, etc., or analogues thereof may be used.

In the image-forming process of this invention wherein the image of a mobile hydrophilic dye is transferred onto an image-fixing layer under a high temperature state under which the hydrophilic thermal solvent exists, the transfer of the mobile dye may be initiated simultaneously with the release of the dye or after completing the release of the dye. Accordingly, heating for the transfer of the dye may be performed after the heat development or simultaneously with the heat development. By the term "simultaneously with the heat development" is meant that heating for the development also acts as heating for transferring the dye released. The optimum temperature for the heat development and the heating time necessary for the heat development do not always coincide with the optimum temperature for the dye transfer and the heating time necessary for the dye transfer, and hence these heating temperatures can be separately selected.

By the term "under a high temperature state under which the hydrophilic thermal solvent exists" is meant the state having an atmospheric temperature higher than 60° C. under which the hydrophilic thermal solvent exists.

Since the heating temperature for the transfer of the dye is 60° C. to 250° C. from the viewpoint of the shelf life, the workability, etc., of light-sensitive materials, substances capable of exhibiting the action as the hydrophilic thermal solvent at the temperature range can be properly selected. It is as a matter of course necessary that the hydrophilic thermal solvent quickly assists the transfer of dye by heating but considering the heat resistance, etc., of light-sensitive materials together, the melting point required for the hydrophilic thermal solvent is 40° C. to 250° C., preferably 40° C. to 200° C., more preferably 40° C. to 150° C.

"The hydrophilic thermal solvent" in this invention is defined to be a compound which is in a solid state at ambient temperature but becomes in a liquid state by heating and in which the inorganisity/organisity value is larger than 1 and the solubility in water at ambient temperature is higher than 1. In this case, the organisity and the inorganisity are the concept of estimating the properties of a compound and the details are described in *Kagaku no Ryoiki (The Domain of Chemistry)*, 11, 719 (1957).

Since the hydrophilic thermal solvent has a role of assisting the transfer of the hydrophilic dye, it is preferred that the thermal solvent be a compound capable of acting as a solvent for the hydrophilic dye.

In general, it is experimentally known that in a solvent preferred for dissolving an organic compound, the inorganisity/organisity value of the solvent is similar to the inorganisity/organisity value of the organic compound. On the other hand, the inorganisity/ organisity value of the non-diffusible 2-equivalent coupler used in this invention is about 1 and the inorganisity/organisity value of the hydrophilic dye released from the non-diffusible 2-equivalent coupler is larger than 1, preferably larger than 1.5, more preferably larger than 2. It is preferred that the hydrophilic thermal solvent can transfer the hydrophilic dye only and cannot transfer the non-diffusible 2-equivalent coupler and hence it is necessary that the inorganisity/organisity value of the hydrophilic thermal solvent is larger than the inorganisity/organisity value of the non-diffusible 2-equivalent coupler. In other words, it is a necessary condition that the inorganisity/ organisity value of the hydrophilic thermal solvent is larger than 1, preferably larger than 2.

On the other hand, from the viewpoint of the size of a molecule, it is considered to be preferred that a molecule capable of transferring without obstructing the transfer of a dye exists around the transferring dye. Accordingly, it is preferred that the molecular weight of the hydrophilic thermal solvent in this invention is smaller and is less than about 200, more preferably less than about 100.

It is sufficient that the hydrophilic thermal solvent used in this invention can substantially assist the transfer of the hydrophilic dye formed by the heat development onto the dye-fixing layer. Therefore, the hydrophilic thermal solvent may be incorporated in the dye-fixing layer as well as in the light-sensitive layer, etc., of the light-sensitive material, in both the dye-fixing layer and light-sensitive layer, or an independent layer containing the hydrophilic thermal solvent may be formed in the dye-fixing material having a dye-fixing layer. From the viewpoint of increasing the transfer efficiency of the dye onto the dye-fixing layer, it is preferred that the hydrophilic thermal solvent be incorporated in the dye-fixing layer and/or a layer adjacent to the dye-fixing layer.

The hydrophilic thermal solvent is usually dispersed in a binder with dissolved in water but may be dispersed with dissolved in an alcohol such as methanol, ethanol, etc.

The coating amount of the hydrophilic thermal solvent used in this invention is 5 to 500% by weight, preferably 20 to 200% by weight, more preferably 30 to 150% by weight of the total coating amount of the layers of the light-sensitive material and/or the dye-fixing material.

Examples of the hydrophilic thermal solvent used in this invention are ureas, pyridines, amides, sulfonamides, imides, alcohols, oximes, and other heterocyclic compounds.

Practical examples of the hydrophilic thermal solvent used in this invention are shown below.

$$H_2N\overset{\overset{\displaystyle O}{\|}}{C}NH_2 \quad (1)$$

$$H_2N\overset{\overset{\displaystyle O}{\|}}{C}NHCH_3 \quad (2)$$

$$H_2N\overset{\overset{\displaystyle O}{\|}}{C}NHC_2H_5 \quad (3)$$

$$CH_3NH\overset{\overset{\displaystyle O}{\|}}{C}NHCH_3 \quad (4)$$

$$HOCH_2NH\overset{\overset{\displaystyle O}{\|}}{C}NH_2 \quad (5)$$

$$HOCH_2NH\overset{\overset{\displaystyle O}{\|}}{C}NHCH_2OH \quad (6)$$

$$HOC_2H_4NH\overset{\overset{\displaystyle O}{\|}}{C}NHC_2H_4OH \quad (7)$$

$$H_2N\overset{\overset{\displaystyle O}{\|}}{C}NHC_2H_4OH \quad (8)$$

$$H_2N\overset{\overset{\displaystyle O}{\|}}{C}N(C_2H_4OH)_2 \quad (9)$$

-continued
(10)
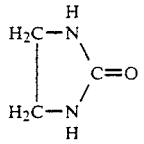
(11)
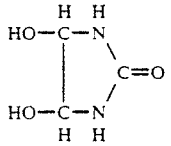
(12)
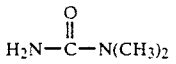
(13)
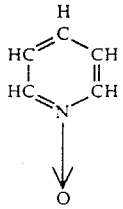
(14)
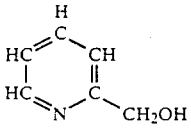
(15)
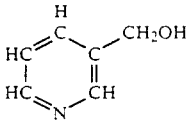
(16)
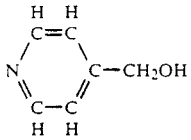
(17)
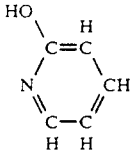
(18)
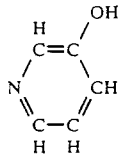
(19)
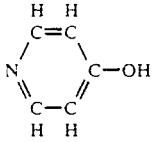
-continued
(20)
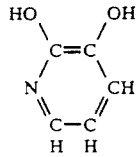
(21)
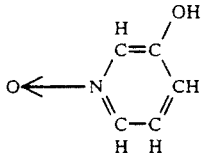
(22)
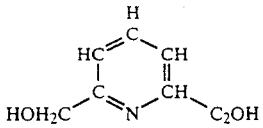
(23)
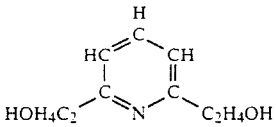
(24)
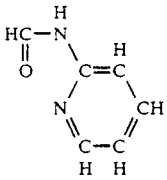
(25)
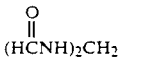
(26)
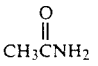
(27)
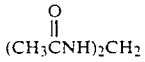
(28)
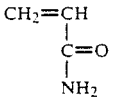
(29)
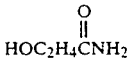
(30)
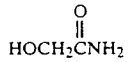
(31)
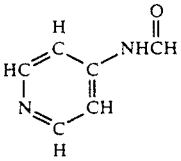
(32)
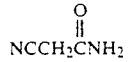
(33)
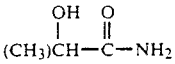
(34)
$CH_3SO_2NH_2$ -continued $HOCH_2SO_2NH_2$ (35)

$H_2NSO_2NH_2$ (36)

$H_3CNHSO_2NH_2$ (37)

$HOCH_2SO_2NHCH_3$ (38)

$(CH_3)_2N-SO_2NH_2$ (39)

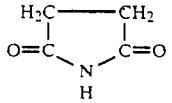
(40)

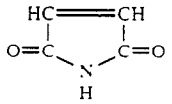
(41)

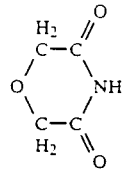
(42)

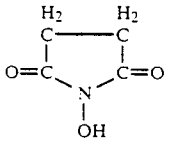
(43)

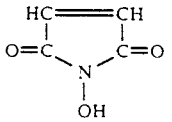
(44)

$(CH_3CO)_2NH$ (45)

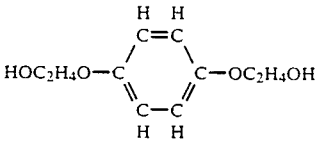
(46)

$HOCH_2(CHOH)_3CH_2OH$ (47)

$CH_3C(CH_2OH)_3$ (48)

$C_2H_5C(CH_2OH)_3$ (49)

$O_2NC(CH_2OH)_3$ (50)

Sorbit (51)

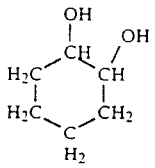
(52)

-continued

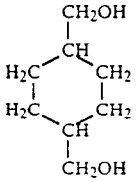
(53)

$HOCH_2-CH=CH-CH_2OH$ (54)

$CH_3CH=NOH$ (55)

$HON=CHCH=NOH$ (56)

$CH_3C(=NOH)-CH_3C=O$ (57)

$HOCH_2CH=NOH$ (58)

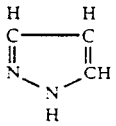
(59)

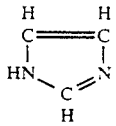
(60)

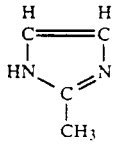
(61)

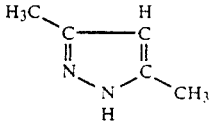
(62)

Among the foregoing compounds, the ureas (1), (2), (3) and (10); pyridines (17) and (19); the amides (26), (30) and (33); sulfonamides (34) and (36); the imides (40), (41), (43) and (44); and the alcohols (36) and (54) are particularly preferred. These hydrophilic thermal solvents may be used solely or as a mixture of two or more kinds.

In the image-forming process of this invention wherein the imagewise released hydrophilic mobile dye is transferred under a high temperature state of higher than 60° C. under which the hydrophilic therml solvent exists, a dye-fixing layer for fixing the dye image is necessary. For this purpose, the heat developable color light-sensitive material of this invention is composed of a support having thereon a light-sensitive layer (I) containing at least silver halide, a reducing agent for the silver halide, a hydrophilic binder, and a non-diffusible 2-equivalent coupler capable of forming a mobile dye and, if necessary, containing the organic silver salt oxidizing agent, and a dye fixing layer (II) capable of receiving the hydrophilic mobile dye formed in the light-sensitive layer (I).

The above-described light-sensitive layer (I) and the dye fixing layer (II) may be formed on the same support, or they may be formed on different supports, respectively. The dye fixing layer (II) can be stripped off the light-sensitive layer (I). For example, after the heat developable color light-sensitive material is exposed imagewise to light, it is developed by heating uniformly and thereafter the dye fixing layer (II) or the light-sensitive layer (I) is peeled apart. Also, when a light-sensitive material having the light-sensitive layer coated on a support and a fixing material having the dye fixing layer (II) coated on a support are separately formed, after the light-sensitive material is exposed imagewise to light and uniformly heated, the mobile dye can be transferred on the dye fixing layer (II) by superposing the fixing material on the light-sensitive material.

Further, there is a method wherein only the light-sensitive layer (I) is exposed imagewise to light and then heated uniformly by superposing the dye fixing layer (II) on the light-sensitive layer (I).

The close contact of the light-sensitive material and the dye-fixing material can be performed by an ordinary manner such as press roller, etc., and for satisfying the close contact, heating may be employed together with the means for the close contact.

In the case of closely contacting the surface of the light-sensitive material with the dye-receiving surface of the dye-fixing material after being subjected to heat development after or simultaneously with imagewise exposure and then heating the assembly, the heating may contribute to the transfer of dye and hence from the viewpoint, the heating temperature and the heating time may be independently selected from the conditions of heating for the development.

In the case of employing the process, it is preferred that the heating for development is finished as quick as possible so that the heating does not contribute the transfer of dye and, on the other hand, it is preferred for obtaining a clear image to keep the temperature in heating for transferring the imagewise released dye onto the dye-fixing layer as low as possible for not causing a thermal reaction at the unexposed areas in the proper range of the transferring-time.

Dye fixing layer (II) may have a white reflecting layer. For example, a layer of a dispersion of titanium dioxide in gelatin may be formed on a mordant layer formed on a transparent support. The titanium dioxide layer forms a white opaque layer and by viewing the transferred image from the transparent support side, a reflection-type color image is obtained.

For the transfer of a dye from the light-sensitive layer onto the dye-fixing layer, a dye transfer assistant can be used. As the dye transfer assistant, water, sodium hydroxide, potassium hydroxide, an aqueous solution of a base containing an inorganic alkali metal salt, etc., may be used. Also, a low boiling organic solvent such as methanol, N,N-dimethylformamide, acetone, diisobutyl ketone, etc., or a mixture of the low boiling organic solvent and water or an aqueous alkaline solution may be used. The dye transfer assistant may be used in a method of wetting the image-receiving layer with the solvent or may be incorporated in the light-sensitive material as crystals or microcapsules.

The dye-fixing layer may further contain a dye mordant for fixing dye, the hydrophilic thermal solvent for assisting the transfer of dye, a base and/or a base precursor for accelerating the dye-releasing reaction, etc., and further a binder. In the case of forming the dye-fixing layer on a support separately from the light-sensitive material, it is particularly preferred that the dye-fixing layer contains a base and/or a base precursor.

When the dye mordant is a polymer mordant, the polymer mordant acts as a binder and in the case of using such a polymer binder, the amount of a binder may be reduced or a binder may not be used. On the contrary, when a binder has a function as a mordant, a dye mordant may not be used. As the binder used for the purpose, a binder used for light-sensitive materials can be used.

The mordant used for the dye-fixing layer can be selected from the mordants usually used. Of the mordants, a polymer mordant is particularly preferred. Polymer mordants used in this invention are polymers containing secondary and tertiary amino groups, polymers containing nitrogen-containing heterocyclic moieties, polymers having quaternary cation groups thereof, having a molecular weight of from 5,000 to 200,000, and particularly from 10,000 to 50,000.

For example, there are illustrated vinylpyridine polymers and vinylpyridinium cation polymers as disclosed in U.S. Pat. Nos. 2,548,564, 2,484,430, 3,148,061 and 3,756,814, etc., polymer mordants capable of cross-linking with gelatin as disclosed in U.S. Pat. No. 3,625,694, 3,859,096 and 4,128,538, British Patents 1,277,453, etc., aqueous sol type mordants as disclosed in U.S. Pat. Nos. 3,958,995, 2,721,852 and 2,798,063, Japanese Patent Application (OPI) Nos. 115228/79, 145529/79 and 126027/79, etc., water-insoluble mordants as disclosed in U.S. Pat. No. 3,898,088, etc., reactive mordants capable of forming covalent bonds with dyes used as disclosed in U.S. Pat. No. 4,168,976 (Japanese Patent Application (OPI) No. 137333/79), etc., and mordants disclosed in U.S. Pat. Nos. 3,709,690, 3,788,855, 3,642,482, 3,488,706, 3,557,066, 3,271,147 and 3,271,148, Japanese Patent Application (OPI) Nos. 71332/75, 30328/78, 155528/77, 125/78 and 1024/78, etc.

In addition, mordants disclosed in U.S. Pat. Nos. 2,675,316 and 2,882,156 can be used.

Of these mordants, for example, mordants capable of cross-linking with a matrix such as gelatin, water-insoluble mordants, and aqueous sol (or latex dispersion) type mordants are preferably used.

Particularly preferable polymer mordants are described below.

(1) Polymers having quaternary ammonium groups and groups capable of forming-covalent bonds with gelatin (for example, aldehydo groups, chloroalkanoyl groups, chloroalkyl groups, vinylsulfonyl groups, pyridinium-propionyl groups, vinylcartonyl groups, alkylsulfonoxy groups, etc.), such as

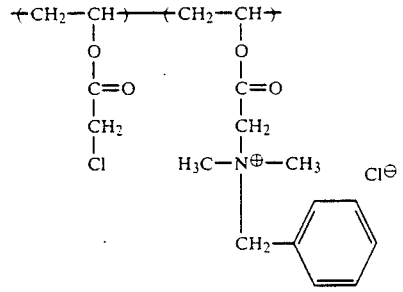

(2) Reaction products between a copolymer comprising a repeating unit of a monomer represented by the general formula described below with a repeating unit of another ethylenically unsaturated monomer and a cross-linking agent (for example, bisalkanesulfonate, bisarenesulfonate, etc.):

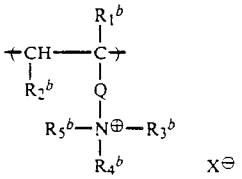

wherein $R_1^b$ represents H or an alkyl group, $R_2^b$ represents H, an alkyl group or an aryl group, Q represents a divalent group, $R_3^b$, $R_4^b$ and $R_5^b$ each represents an alkyl group, an aryl group or at least two of $R_3^b$ to $R_5^b$ are bonded together to form a hetero ring, and $X^\ominus$represents an anion. The above-described alkyl groups and aryl groups may be substituted.

(3) Polymers represented by the following general formula

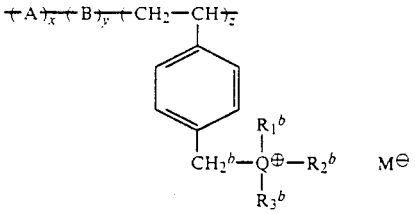

wherein x is from about 0.25 mol% to about 5 mol%, y is from about 0 mol% to about 90 mol%, z is from about 10 mol% to about 99 mol%, A represents a monomer having at least two ethylenically unsaturated bonds, B represents a copolymerizable ethylenically unsaturated monomer, Q represents N or P, $R_1^b$, $R_2^b$ and $R_3^b$ each represents an alkyl group or a cyclic hydrocarbon group or at least two of $R_1^b$ to $R_3^b$ are bonded together to form a ring (these groups and rings may be substituted), and $M^\ominus$represents an anion.

(4) Copolymers composed of (a), (b) and (c), wherein (a) is

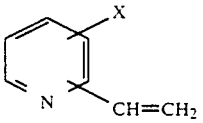

or

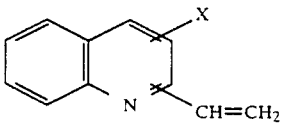

wherein X represents a hydrogen atom, an alkyl group or a halogen atom (the alkyl group may be substituted);

(b) is an acrylic ester; and (c) is acrylonitrile.

(5) Water-insoluble polymers wherein at least 1/3 of the repeating units are those represented by the following general formula

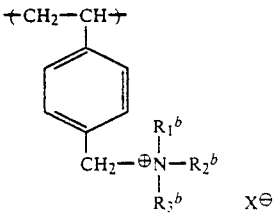

wherein $R_1^b$, $R_2^b$ and $R_3^b$ each represents an alkyl group, with the total number of carbon atoms included being 12 or more (the alkyl group may be substituted), and $X^\ominus$represents an anion.

Various kinds of known gelatins can be employed as gelatin for the mordant layer. For example, gelatin which is produced in a different manner such as lime-processed gelatin, acid-processed gelatin, etc., or a gelatin derivative which is prepared by chemically modifying gelatin such as phthalated gelatin, sulfonylated gelatin, etc., can be used. Also, gelatin subjected to a desalting treatment can be used, if desried.

The ratio of polymer mordant to gelatin and the amount of the polymer mordant coated can be easily determined by one skilled in the art depending on the amount of the dye to be mordanted, the type and composition of the polymer mordant and further on the imageforming process used. Preferably, the ratio of mordant to gelatin is from 20/80 to 80/20 (by weight) and the amount of the mordant coated is from 0.5 to 8 $g/m^2$.

The typical dye-fixing material used in this invention can be obtained by coating a mixture of a polymer containing the ammonium salt and gelatin on a transparent support. In other practical embodiment of this invention, a non-mordanting organic polymer capable of receiving a mobile dye or mobile dyes may be used as a support or on a support.

The support for receiving a dye used in this invention or a non-mordanting organic polymer having dye-receiving property formed on a support is a substance capable of retaining thereon a light-sensitive layer and at the same time receiving a dye released from the non-diffusible 2-equivalent coupler during the heat development. The support and the organic polymer suitable for the purpose are composed of heat resisting organic high molecular substances having a glass transition temperature of 40° C. to 250° C. and are used as films or resin plates. The mechanism that the dye released from the non-diffusible 2-equivalent coupler is transferred into the support has not yet been clarified in various points. In general, however, it is considered that the thermal motion of a polymer chain becomes larger at a processing temperature higher than the glass transition point of the polymer to form, thereby, gaps of the chain-form molecule and the dye can enter the gaps.

Examples of the organic polymers used in this invention include polystyrene having a molecular weight of 2,000 to 85,000, polystyrene derivatives having a substituent of less than 4 carbon numbers, polyvinylcyclohexane, polyvinylbenzene, polyvinylpyrrolidone, polyvinylcarbazole, polyallylbenzene, polyvinyl alcohol, polyacetals such as polyvinylformal, polyvinylbutyral, etc., polyvinyl chloride, chlorinated polyethylene, polyethylene trichlorofluoride, polyacrylonitrile, poly-N,N-dimethylallylamide, polyesters such as a polyacrylate having a p-cyanophenyl group, a pentachlorophenyl group, or a 2,4-dichlorophenyl group, polyacryl chloroacrylate, polymethyl methacrylate, polyethyl methacrylate, polypropyl methacrylate, polyisopropyl methacrylate, polyisobutyl methacrylate, poly-t-butyl methacrylate, polycyclohexyl methacrylate, polyethylene glycol dimethacrylate, poly-2-cyanoethyl methacrylate, polyethylene terephthalate, or etc., polysulfone, bisphenol A polycarbonate, polycarbonates, polyanhydrides, polyamides, and cellulose acetates.

Also, the synthetic polymers having a glass transition point of 40° C. to 250° C. described in *Polymer Handbook*, 2nd Edition (edited by J. Brandrup and E.H. Immergut), published by John Wiley & Sons Co. are useful as the organic polymers in this invention. These polymers may be used solely or may be used as copolymers of them.

Examples of the support advantageously used in this invention are the films of cellulose acetates such as triacetate, diacetate, etc.; films of polyamides such as combinations of heptamethylenediamine and terephthalic acid, fluorenedipropylamine and adipic acid, hexamethylenediamine and diphenic acid, hexamethylenediamine and isophthalic acid, etc.; films of polyesters such as the combinations of diethylene glycol and diphenylcarboxylic acid, bis-p-carboxyphenoxybutane and ethylene glycol, etc.; polyethylene terephthalate films, polycarbonate films, etc. These films may be denatured. For example, a polyethylene terephthalate film denatured by using cyclohexane dimethanol, isophthalic acid, methoxypolyethylene glycol, 1,2-dicarbomethoxy-4-benzenesulfonic acid, etc., as a reforming agent is advantageously used.

When the dye-fixing layer is disposed at the surface, a protective layer may be further formed thereon, if necessary. As such a protective layer, a material generally used as a protective layer for light-sensitive materials may be used but when a dye-fixing layer is formed on a dye-fixing material separately from a light-sensitive material, it is preferred to render the protective layer hydrophilic for not hindering the transfer of the hydrophilic dye.

In this invention, it is advantageous to use a water releasing compound in the light-sensitive material and/or the dye-fixing material, whereby the release of the dye and/or the transfer of the mobile dye thus formed is accelerated.

The water releasing compound means a compound which releases water by decomposition during heat development. These compounds are particularly known in the field of printing of fabrics, and $NH_4Fe(SO_4)_2.12H_2O$, etc., as described in Japanese Patent Application (OPI) No. 88386/75 are useful.

In the photographic light-sensitive material and the dye fixing material of this invention, the photographic emulsion layer and other binder layers may contain inorganic or organic hardeners. It is possible to use chromium salts (chromium alum, chromium acetate etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloylhexahydro-s-triazine, 1,3-vinylsulfonyl-2-propanol, etc.), active halogen compounds (2,4-dichloro-6hydroxy-s-triazine, etc.), mucohalogenic acids (mucochloric acid, mucophenoxychloric acid, etc.), etc., which are used individually or as a combination thereof.

Also, as a heating means for transferring the dye, foregoing various means used as heating means for the heat development can be employed in this invention.

The dye-fixing layer, the protective layer, the inter layer, the subbing layer, the backing layer and other layers can be produced by preparing each coating solution, applying to a support by various coating methods such as a dip coating method, an air-knife coating method, a curtain coating method or a hopper coating method as described in U.S. Pat. No. 2,681,294 and drying in the same manner as used in preparing the heat developable light-sensitive layer and other layers of this invention, and drying them by which the light-sensitive material having the dye-fixing layer or the dye-fixing material wherein the fixing layer is present on the different support are obtained.

Various means of exposure can be used in the present invention. Latent images are obtained by imagewise exposure by radiant rays including visible rays. Generally, light sources used for conventional color prints can be used, examples of which include tungsten lamps, mercury lamps, halogen lamps such as iodine lamps, xenon lamps, laser light sources, CRT light sources, fluorescent tubes and light-emitting diodes, etc.

The original may be line drawings or photographs having gradation. Further, it is possible to take a photograph of a portrait or landscape by means of a camera. Printing from the original may be carried out by contact printing by superposing the original on the material or may be carried out by reflection printing or enlargement printing.

It is also possible to carry out the printing of images photographed by a videocamera or image informations sent from a television broadcasting station by displaying on a cathode ray tube (CRT) or a fiber optical tube (FOT) and focusing the resulting image on the heat developable photographic material by contacting therewith or by means of a lens.

Recently, light-emitting diode (LED) systems which have been greatly improved have begun to be utilized as an exposure means or display means for various apparatus and devices. It is difficult to produce an LED which effectively emits blue light. In this case, in order to reproduce the color image, three kinds of LEDs consisting of those emitting each green light, red light and infrared light are used. The light-sensitive material to be sensitized by these lights is produced so as to release a yellow dye, a magenta dye and a cyan dye, respectively.

The light-sensitive material is produced using a construction such that the green-sensitive part (layer) contains a non-diffusible 2-equivalent yellow dye forming coupler, the red-sensitive part (layer) contains a non-diffusible 2-equivalent magenta dye forming coupler and the infrared-sensitive part (layer) contains a non-diffusible 2-equivalent cyan dye forming coupler. Other combinations can be utilized, if necessary.

In addition to the above-described methods of contacting or projecting the original, there is a method of exposure wherein the original illuminated by a light source is stored in a memory of a reading computer by means of a light-receiving element such as a phototube or a charge coupling device CCD). The information is, if necessary, subjected to processing, the so-called image treatment, and resulting image information is reproduced on CRT which can be utilized as an image-like light source or lights are emitted by three kinds of LED according to the processed information.

The image-forming process of this invention is a very simple image-forming process which can be performed in a completely dry process without supplying a solvent from the outside in the whole steps from light exposure to heat development and dye fixing. Furthermore, in the image-forming process of this invention, the same sensitivity as that of a conventional so-called silver halide photographic light-sensitive material can be maintained; since the dye image formed is fixed in a dye-fixing material, the quality and the preservability of the dye image are very excellent; the color reproducibility is very good; and the reproduction of color images can be also sufficiently performed in spite of the complete dry process.

The image-forming process of this invention having such features can be applied not only to the field of photography but also to the conversion of a so-called soft image to a hard image, which has recently been required. Moreover, since the dye image formed is fixed in a dye-fixing layer or material and hence the preservability of the image is good in the image-forming process of this invention, the process of this invention can be simply utilized in the case of requiring the preservation of dye images for a long period of time and hence the process of this invention is superior to conventional photographic techniques.

Then, the invention will be explained in more detail by the following examples but the invention is not limited by these examples.

EMULSION PREPARATION EXAMPLE 1

Preparation of Silver Iodobromide Emulsion

In 3,000 ml of water were dissolved 40 g of gelatin and 26 g of potassium bromide and the solution was stirred at 50° C. Then, a solution of 34 g of silver nitrate dissolved in 200 ml of water was added to the foregoing solution over a 10 minute period and thereafter a solution of 3.3 g of potassium iodide dissolved in 100 ml of water was added thereto over a 2 minute period. The pH of the silver iodobromide emulsion thus prepared was adjusted to form precipitates and after removing excessive salts thus precipitated, the pH of the emultion was adjusted to 6.0 to provide 400 g of a silver iodobromide emulsion.

EMULSION PREPARATION EXAMPLE 2

Preparation of Silver Benzotriazole Emulsion

In 3,000 ml of water were dissolved 28 g of gelatin and 13.2 g of benzotriazole and then the solution was stirred at 40° C. A solution of 17 g of silver nitrate dissolved in 100 ml of water was added to the solution over a period of 2 minutes. The pH of the silver benzotriazole emulsion thus obtained was adjusted to form the precipitates of excessive salts, which were removed, and then the pH of the emulsion was adjusted to 6.0 to provide 400 g of a silver benzotriazole emulsion.

EMULSION PREPARATION EXAMPLE 3

Preparation of Silver Benzotriazole Emulsion Containing Photosensitive Silver Bromide In 1,000 ml of water were dissolved 10 g of gelatin and 6.5 g of benzotriazole and then the solution was stirred at 50° C. A solution of 8.5 g of silver nitrate dissolved in 100 ml of water was added to the foregoing solution over a period of 2 minutes and further a solution of 1.2 g of potassium bromide dissolved in 50 ml of water was added thereto over a period of 2 minutes. By adjsuting the pH of the emulsion thus prepared, excessive salts were precipitated and after removing the salts thus precipitated, the pH of the emulsion was adjusted to 6.0 to provide 200 g of a silver benzotriazole emulsion containing silver bromide.

PREPARATION EXAMPLE OF DYE-FIXING MATERIAL Preparation of Dye-Fixing Material R-1

In 200 ml of water was dissolved 10 g of poly(methyl acrylate-co-N,N,N-trimethyl-N-vinylbenzylammonium chloride) (the ratio of methyl acrylate and benzylammonium chloride being 1:1) and the solution was uniformly mixed with 100 g of 10% lime-processed gelatin aqueous solution. The mixture was uniformly coated on a polyethylene terephthalate film at a wet thickness of 20 μm.

Furthermore, a mixture of the following components (a) to (e) was uniformly coated on the layer formed as above at a wet thickness of 60 μm and dried. The 2nd layer is, hereinafter, referred to as a hydrophilic thermal solvent layer.

| | | |
|---|---|---|
| (a) | Urea | 4 g |
| (b) | Water | 8 ml |
| (c) | Aqueous solution of 10% by weight polyvinyl alcohol (saponification value of 98%) | 12 g |
| (d) | Aqueous 5% solution of the compound having the following structure | 2 mg |
| (e) | Aqueous 5% solution of sodium dodecylbenzenesulfonate | 0.5 ml |

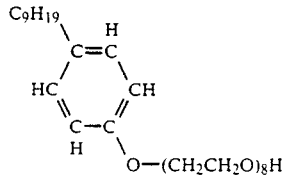

LIGHT-SENSITIVE MATERIAL PREPARATION EXAMPLE 1

Preparation of Light-Sensitive Material E-1

To 100 g of an aqueous 10% gelatin solution prepared by dissolving gelatin in water at 40° C. was added 0.5 g of sodium dodecylbenzenesulfonate and the mixture was stirred. A mixture of 10 g of Non-Diffusible Coupler (M-1) of this invention, 10 g of tricresyl phosphate, and 20 ml of ethyl acetate was heated to form a solution. The coupler-containing solution was mixed with the foregoing aqueous gelatin solution containing the surface active agent in a homogenizer for 3 minutes at 12,000 rpm to provide a coupler emulsion.

Light-Sensitive Material E-1 was prepared as follows.

| | | |
|---|---|---|
| (a) | Silver iodobromide emulsion | 5.5 g |
| (b) | Aqueous 10% gelatin solution | 2 g |
| (c) | Dispersion of Coupler (M-1) | 2.5 g |
| (d) | Ethanol solution of 10% guanidine trichloroacetate | 0.5 ml |
| (e) | Methanol solution of 10% 2,6-dichloro-4-aminophenol | 0.5 ml |
| (f) | Aqueous solution of 5% of the compound of the following structure | 1 ml |

-continued

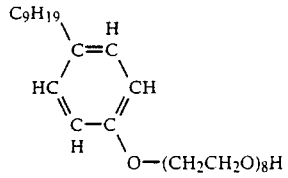

(g) Water 6 ml

LIGHT-SENSITIVE MATERIAL PREPARATION EXAMPLE 2

Preparation of Light-Sensitive Material E-0

By following the same procedure as in the case of preparing Light-Sensitive Material E-1 except that the comparison coupler having the following structure was used in place of Coupler (M-1), comparison Light-Sensitive Material E-0 was prepared.

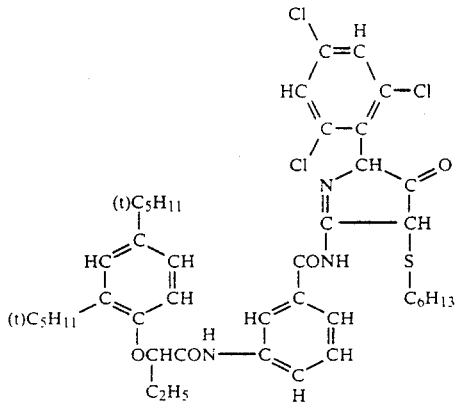

EXAMPLE 1

Each of Light-Sensitive Materials E-1 and E-0 prepared in Light-Sensitive Material Preparation Examples 1 and 2, respectively, was imagewise exposed to a tungsten lamp at 2,000 lux for 10 seconds. Thereafter, each sample was uniformly heated on a heat block heated to 130° C. for 30 seconds Then, each of the light-sensitive materials was closely superposed on Dye-Fixing Material R-1 prepared in Dye-Fixing Material Example in a face-to-face relationship and the assembly was heated on a heat block at 120° C. for 30 seconds..

When the dye-fixing material was separated from the light-sensitive material, a negative magenta color image was obtained on the dye-fixing material in the case of using Light-Sensitive Material E-1. On the other hand, no color image was formed on the dye-fixing material in the case of using Comparison Light-Sensitive Material E-0.

When the density of the magenta dye image in the former case was measured using a Macbeth densitometer (TD-504), the maximum density was 1.23 and the minimum density was 0.23.

EXAMPLE 2

By following the sane procedure as in Light-Sensitive Material Preparation Example 1 except that Coupler (C-1) was used in place of Coupler (M-1), Light-Sensitive Material 2 was prepared.

Then, by following the same procedure as in Dye-Fixing Material Preparation Example except that the hydrophilic thermal solvent shown in Table 1 was used in place of urea used in the Preparation Example, each of Dye-Fixing Materials R-2 to R-6 was prepared.

After performing the same light exposure and heating as in Example 1 except that Light-Sensitive Material E-2 was used in place of Light-Sensitive Material E-1 and each of Dye-Fixing Materials R-2 to R-6 was used in place of Dye-Fixing Material R-1, the dye-fixing material was separated from the light-sensitive material and then the density measurement was performed. The results obtained are shown in Table 1.

TABLE 1

| Dye-Fixing Material | Hydrophilic Thermal Solvent | Maximum Density | Minimum Density |
|---|---|---|---|
| R-2 | N-Methylurea (4 g) | 1.20 | 0.25 |
| R-3 | Pyridine-N-oxide (4 g) | 1.25 | 0.27 |
| R-4 | Sulfonamide (4 g) | 1.23 | 0.20 |
| R-5 | Urea/N-Methylurea (2 g/2 g) | 1.14 | 0.26 |
| R-6 | Urea/N-Methylurea/ Ethyleneurea/Ethylurea (1 g/1 g/1 g/1 g) | 1.10 | 0.33 |
| R-1* | Urea | 1.13 | 0.23 |

*The result in Example 1.

EXAMPLE 3

By following the same procedure as in Light-Sensitive Material Preparation Example 1 except that 5 g of silver iodobromide emulsion and 5 g of silver, benzotriazole (Emulsion Preparation Example 2) were used in place of 10 g of silver iodobromide and each of the couplers shown in Table 2 was used in place of Coupler (M-1), each of Light-Sensitive Materials E-3 to E-7 was prepared.

After performing the light exposure and heating as in Example 1 except that Light-Sensitive Materials E-3 to E-7 were used in place of Light-Sensitive Materials E-1 and E-0, the density measurement was performed about each of the negative color images thus obtained. The results are shown in Table 2.

TABLE 2

| Light-Sensitive Material | Coupler of this Invention | Hue | Maximum Density | Minimum Density |
|---|---|---|---|---|
| E-3 | Y-1 | Yellow | 0.80 | 0.20 |
| E-4 | Y-2 | Yellow | 0.75 | 0.15 |
| E-5 | M-5 | Magenta | 1.23 | 0.21 |
| E-6 | M-3 | Magenta | 1.15 | 0.23 |
| E-7 | C-2 | Cyan | 1.02 | 0.20 |

EXAMPLE 4

By following the same procedure as in Light-Sensitive Material Preparation Example 1 except that 10 g of the silver benzotriazole emulsion containing silver bromide (Emulsion Preparation Example 3) was used in place of 10 g of the silver iodobromide emulsion used in Preparation Example 1, Light-Sensitive Material E-8 was prepared.

After performing the light exposure and heating as in Example 1 except that Light-Sensitive Material E-8 was used in place of Light-Sensitive Materials E-1 and E-0, the density measurement of the image formed was performed. The maximum density of the negative magenta color image formed on the dye-fixing material separated from the light-sensitive material was 1.08 and the minimum density thereof was 0.30.

EXAMPLE 5

By following the same procedure as in Light-Sensitive Material Example 1 except that 2,4-dichloro-p-aminophenol used in Preparation Example 1 was not used, Light-Sensitive Material E-9 was prepared.

Also, by following the same procedure as in Dye-Fixing Material Preparation Example except that a solution of 500 mg of 2,4-dichloro-p-aminophenol dissolved in 3 ml of methanol was added to the coating liquid used in Preparation Example, Dye-Fixing Material R-7 was prepared.

Light-Sensitive Material E-9 thus prepared was imagewise exposed to a tungsten lamp at 2,000 lux for 10 seconds, closely superposed on Dye-Fixing Material R-7 in a face-to-face relationship, and the assembly was heated on a heat block to 130° C. for 45 seconds.

When the dye-fixing material was separated from the light-sensitive material, a negative color image was obtained in the dye-fixing material. When the density of the negative color image was measured using a Macbeth densitometer (TD-504), the maximum density was 1.02 and the minimum density was 0.29.

While the invention has been described in detail and with reference to specific embodiments thereof, it will be apparent to one skilled in the art that various changes and modifications can be made therein without departing from the spirit and scope thereof.

What is claimed is:

1. A dry image-forming process which comprises transferring to a dye-fixing material a mobile hydrophilic dye formed imagewise at exposure areas of a heat developable light-sensitive material comprising a support having hereon at least a light-sensitive material comprising a support having hereon at least a light-sensitive silver halide, a hydrophilic binder, a reducing agent for the silver halide, and a non-diffusible 2 -equivalent coupler which is dispersed in the hydrophilic binder, said non-diffusible 2-equivalent coupler being a compound which forms a hydrophilic dye by combining with the oxidation product of a reducing agent formed by the reaction of a p-aminophenol derivative or a p-phenylenediamine derivative and a silver halide, said non-diffusible 2-equivalent coupler being selected from the group consisting of compounds of the following formula (I) to (IX):

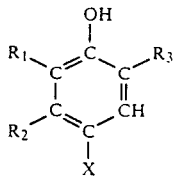

(I)

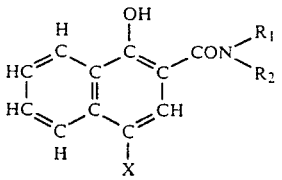

(II)

-continued

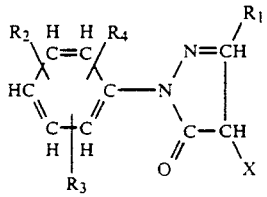

(III)

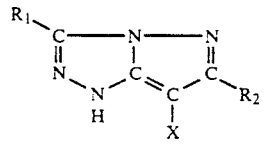

(IV)

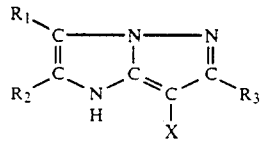

(V)

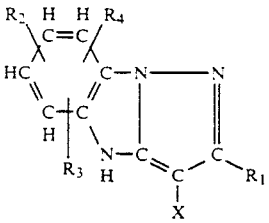

(VI)

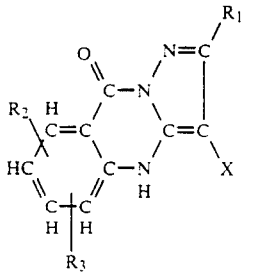

(VII)

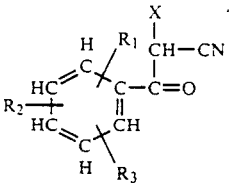

(VIII)

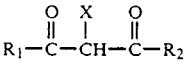

(IX)

wherein $R_1$ to $R_4$ each represents a hydrogen atom, an alkyl group, an alkenyl group, a cycloalkyl group, an aryl group, an aralkyl group, an alkoxy group, an aryloxy group, an acyl group, an acycloxy group, an acylamino group, an alkoxyalkyl group, an aryloxyalkyl group, an alkoxycarbonyloxy group, an alkoxycarbonylamino group, an alkoxycarbonyl group, a carbamoyl group, a substituted carbamoyl group, an arylamino group, a cycloalkylamino group, a halogen group, a cyano group, an acyloxyalkyl group, a nitro group, an alkylsulfonyl group, an aryl sulfonyl group, a hydroxy group, a carboxy group, a sulfo group, a ureido group, a substituted uriedo group, a sulfamoylamino group, a substituted sulfamoylamino group, an alkylsulfonyloxy group, an arylsulfonyloxy group, an alkylsulfonylamino group, an arylsulfonylamino group, an alkylthio group, an arylthio group, a heterocyclic residue, an amido group, or a quaternary ammonium group; the total carbon atom number of $R_1$ to $R_4$ is less than 12 and the carbon atom number of each substitutent is 8 or less; X is a group which is released at the case of combining with the oxidation product of a reducing agent, selected from the group consisting of an alkoxy group, an aryloxy group, an acyloxy group, an alkoxycarbonyloxy group, a carbamoyloxy group, a substituted carbamoyloxy group, an alkylsulfonyloxy group, an arylsulfonyloxy group, an alkylsulfonylamino group, an arylsulfonylamino group, a perfluoroacyclamino group, a sulfamoylamino group, a substituted sulfamoylamino group, an alkylsulfonyl group, an arylsulfonyl group, an alkylthio group, an arylthio group, a heterocyclic thio group, an arylazo group, a heterocyclic residue, and an imido group; and the total carbon atom number of X is 8 or more, by heating the light-sensitive material after imagewise exposure or simultaneously with imagewise exposure together with a dye-fixing material having a dye-fixing layer and said hydrophilic thermal solvent in a coating amount of 20 to 200% by weight, based on the total coating amount of all layers of the light-sensitive material and the dye-fixing material, at a high temperature at which the hydrophilic thermal solvent is in a molten state without supplying a solvent from the outside, and fixing the dye in a dye-fixing layer and wherein said heat developable light-sensitive material further comprises a compound represented by the following general formula:

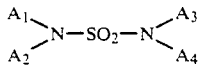

(A)

wherein $A_1$, $A_2$, $A_3$ and $A_4$, which may be the same or different, each represents a hydrogen atom or a substitutent selected from an alkyl group, a substituted alkyl group, a cycloalkyl group, an aralkyl group, an aryl group, a substituted aryl group and a heterocyclic group; and $A_1$ and $A_2$ or $A_3$ and $A_4$ may combine with each other to form a ring, and wherein said hydrophilic thermal solvent is a compound which is in a solid at an ambient temperature but becomes in a liquid state by heating and in which the inorganic property/organic property value is larger than 1 and the solubility in water at ambient temperature is higher than 1.

2. A dry image-forming process as claimed in claim 1, wherein the heating for the transfer is carried out at a temperature of 60° C. to 250° C.

3. A dry image-forming process as claimed in claim 1, wherein $R_1$ to $R_4$ further have a substituent selected from the group consisting of a hydroxy group, a carboxy group, a sulfo group, an alkoxy group, a cyano group, a nitro group, an alkyl group, an aryl group, an aryloxy group, an acyloxy group, an acyl group, a sulfamoyl group, a substituted sulfamoyl group, a carbamoyl group, a substituted carbamoyl group, an acylamino group, an alkylsulfonylamino group, an arylsulfonylamino group, a sulfamoylamino group, a substituted sulfamoylamino group, an imido group, a halogen atom, and a quaternary ammonium group.

4. A dry image-forming process as claimed in claim 1, wherein X further has a substituent selected from the group consisting of an alkyl group, an alkenyl group, a cycloalkyl group, an aralkyl group, an aryl group, a halogen atom, an alkoxy group, an aryloxy group, an acyl group, an acylamino group, an acyloxy group, an alkylsulfonylamino group, an arylsulfonylamino group, an alkylsulfonyloxy group, an arylsulfonyloxy group, an alkoxycarbonyl group, a substituted ureido group, an alkoxycarbonyloxy group, and an alkoxycarbonylamino group.

5. A dry image-forming process as claimed in claim 1, wherein the concentration range of the non-diffusible 2-equivalent coupler is about 0.01 mol to about 4 mols per mol of silver.

6. A dry image-forming process as claimed in claim 5, wherein the concentration range of the non-diffusible 2-equivalent coupler is about 0.05 mol to about 1 mol per mol of silver.

7. A dry image-forming process as claimed in claim 1, wherein said light-sensitive silver halide is silver chloroiodide, silver iodobromide, or silver chloroiodobromide.

8. A dry image-forming process as claimed in claim 1, wherein said heat developable light-sensitive material further comprises an organic silver salt oxidizing agent.

9. A dry image-forming process as claimed in claim 8, wherein said organic silver salt oxidizing agent is a silver salt of an aliphatic carboxylic acid or a silver salt of an aromatic carboxylic acid.

10. A dry image-forming process as claimed in claim 1, wherein said reducing agent is a color developing agent capable of forming a dye by coupling of an oxidation product of the developing agent with the non-diffusible 2-equivalent coupler.

11. A dry image-forming process as claimed in claim 10, wherein the amount of the reducing agent is about 0.1 mol to about 20 mols per mol of 2-equivalent coupler.

12. A dry image-forming process as claimed in claim 1, wherein said heat developable light-sensitive material further comprises an auxiliary developing agent.

13. A dry image-forming process as claimed in claim 12, wherein the concentration range of the auxiliary developing agent is 0.005 mol times to 20 mol times the amount of silver.

14. A dry image-forming process as claimed in claim 1, wherein said hydrophilic binder is a transparent or translucent hydrophilic colloid.

15. A dry image-forming process as claimed in claim 1, wherein said heat developable light-sensitive material and/or a dye-fixing material comprising said dye-fixing layer further comprise bases or base precursors.

16. A dry image-forming process as claimed in claim 15, wherein said bases and base precursors are used in a range of up to 50% by weight based on the amount of a dry layer coated on the light-sensitive material.

17. A dry image-forming process as claimed in claim 1, wherein the compound represented by the general formula (A) is used in a range of up to 20% by weight based on the amount of a dry layer coated of the light-sensitive material.

18. A dry image-forming process as claimed in claim 1, wherein the heating for the development is carried out at a temperature of 80° C. to 250° C.

* * * * *